US012799685B2

(12) United States Patent
Tanaka et al.

(10) Patent No.: US 12,799,685 B2
(45) Date of Patent: Nov. 17, 2026

(54) FACILITY PROTECTION COVER AND FACILITY PROTECTION STRUCTURE USING SAME

(71) Applicants: OBAYASHI CORPORATION, Tokyo (JP); DENSO CORPORATION, Kariya-city (JP)

(72) Inventors: Koichi Tanaka, Tokyo (JP); Eisuke Takahashi, Kariya-city (JP)

(73) Assignees: OBAYASHI CORPORATION, Tokyo (JP); DENSO CORPORATION, Kariya-city (JP)

( * ) Notice: Subject to any disclaimer, the term of this patent is extended or adjusted under 35 U.S.C. 154(b) by 650 days.

(21) Appl. No.: 18/272,974

(22) PCT Filed: Sep. 17, 2021

(86) PCT No.: PCT/JP2021/034311
§ 371 (c)(1),
(2) Date: Jul. 18, 2023

(87) PCT Pub. No.: WO2022/158040
PCT Pub. Date: Jul. 28, 2022

(65) Prior Publication Data

US 2024/0076837 A1 Mar. 7, 2024

(30) Foreign Application Priority Data

Jan. 23, 2021 (JP) ..... 2021-009200

(51) Int. Cl.
*E01C 9/00* (2006.01)
*E01C 1/00* (2006.01)

(52) U.S. Cl.
CPC ..... *E01C 9/00* (2013.01); *E01C 1/002* (2013.01); *E01C 2201/065* (2013.01)

(58) Field of Classification Search
CPC . E01C 9/00; E01C 9/002; E01C 1/002; E01C 2201/065
See application file for complete search history.

(56) References Cited

U.S. PATENT DOCUMENTS 848,068 A * 3/1907 Thacher ..... E01C 9/00 138/108
7,394,025 B1 * 7/2008 Wong ..... H02G 3/305 104/275

(Continued)

FOREIGN PATENT DOCUMENTS

CN 208440964 U 1/2019
JP 2002233019 A * 8/2002

(Continued)

OTHER PUBLICATIONS

University of Tokyo, Graduate School of Frontier Science, "Development of 3rd Generation Wireless In-Wheel Motor—First in the World, all components from receiving power to driving are set in the wheel-", 13 pgs.

*Primary Examiner* — Abigail A Risic
(74) *Attorney, Agent, or Firm* — Maschoff Brennan

(57) ABSTRACT

A facility protection cover is disposed on a concrete foundation and covers a facility device disposed between the facility protection cover and the concrete foundation. The facility protection cover includes a cover body including a fiber-reinforced cement composite. The cover body includes two legs that are spaced apart from each other so as to be located on opposite sides of a facility device placement space. The facility device placement space accommodates the facility device. The cover body includes a bridging portion that bridges the two legs so as to extend over the facility device placement space. The cover body transmits a weight of a vehicle loaded on the cover body to the concrete foundation via the two legs, and restricts a separating (Continued)

relative movement of the two legs along a placement surface of the concrete foundation when the weight of the vehicle is loaded on the bridging portion.

17 Claims, 16 Drawing Sheets

(56) References Cited

U.S. PATENT DOCUMENTS

| | | | | |
|---|---|---|---|---|
| 2018/0096773 | A1* | 4/2018 | Shijo | B60L 53/12 |
| 2019/0094879 | A1* | 3/2019 | Choe | B60L 13/03 |
| 2020/0123719 | A1* | 4/2020 | Nishino | E01D 22/00 |
| 2020/0381164 | A1* | 12/2020 | Ueda | H01F 27/025 |

FOREIGN PATENT DOCUMENTS

| | | | | |
|---|---|---|---|---|
| JP | 2013-060710 | A | 4/2013 | |
| JP | 5374658 | B1 * | 12/2013 | E01C 1/00 |
| JP | 2020186593 | A * | 11/2020 | |
| KR | 101104813 | B1 * | 1/2012 | B60L 53/36 |

* cited by examiner

FACILITY PROTECTION COVER AND FACILITY PROTECTION STRUCTURE USING SAME

TECHNICAL FIELD

The present disclosure mainly relates to a facility protection cover employed to protect a facility device embedded immediately below a road surface from traveling vehicles, and to a facility protection structure using the facility protection cover.

BACKGROUND ART

As a measure for prevention of global warming, drive mechanisms for automobiles are rapidly shifting from internal combustion engines to electric motors in order to reduce emissions of greenhouse gases. However, in order to widely spread electric vehicles (hereinafter referred to as EVs), various problems related to the EVs must be solved.

Such problems include time consuming charging of the battery, short range, and high costs of the battery. In recent years, inventions have been made in which a power receiving coil is disposed in a tire of an automobile and multiple power feeding coils are embedded immediately below a road surface along a traveling direction of the automobile to enable power feeding to the automobile while traveling. Technological development for implementing such inventions has also been advanced (Non-Patent Literature 1).

The technique described in Non-Patent Literature 1 involves embedding power feeding coils in an expressway, an intersection, or the like. This eliminates the concern regarding the charging time. This also increases charging opportunities and thus, large-capacity batteries will be unnecessary. If mounted batteries can have lower capacities, the costs of the batteries, and thus the costs of the EV, will be reduced. In addition, depletion of resources such as cobalt, which is required for battery production, will be prevented.

CITATION LIST

Non-Patent Literature

Non-Patent Literature 1: University of Tokyo, Graduate School of Frontier Science, "DEVELOPMENT OF 3rd GENERATION WIRELESS IN-WHEEL MOTOR-First in the World, all components from receiving power to driving are set in the wheel-", [online], [searched on Jun. 5, 2020], Internet <URL: http://www.k.u-tokyo.ac.jp/info/entry/22_entry772/>

SUMMARY OF INVENTION

Technical Problem

In the technique described in Non-Patent Literature 1, power feeding coils are embedded under the road surface of a concrete pavement body. Accordingly, the concrete pavement body needs to have a function of protecting the power feeding coils in addition to the original functions required for vehicle traveling. If these functions are ensured by increasing the thickness of the concrete immediately above the power feeding coils, the distance between the power feeding coils and the power receiving coil increases, accordingly. Therefore, it is difficult to ensure necessary and sufficient power feeding efficiency at a magnetic field strength that does not conflict with the Radio Act.

However, when the thickness of the concrete immediately above the power feeding coils is reduced, bending cracks occur in the concrete due to the weight of vehicles, which causes a reduction in the function of protecting the power feeding coils and in the functions for vehicle traveling.

Such problems are not unique to power feeding coils, but similarly occur in cases in which it is desired to minimize the embedding depth of various facility devices from the viewpoint of maintenance and inspection when the facility device is embedded under the road surface of a concrete pavement.

Solution to Problem

An objective of the present disclosure is to provide a facility protection cover capable of reducing the thickness of concrete without impairing a protective function for facility devices and road surface functions for traveling vehicles, when various types of facility device including contactless power feeding coils are embedded under the road surface of a pavement body. Another objective is to provide a facility protection structure using the facility protection cover.

To achieve the foregoing objective and in accordance with one aspect, a facility protection cover is configured to be disposed on a concrete foundation and to cover a facility device disposed between the facility protection cover and the concrete foundation. The facility protection cover includes a cover body including a fiber-reinforced cement composite. The cover body includes two legs and a bridging portion. The two legs are spaced apart from each other so as to be located on opposite sides of a facility device placement space. The facility device placement space is configured to accommodate the facility device. The bridging portion bridges the two legs so as to extend over the facility device placement space. The cover body is configured to transmit a weight of a vehicle loaded on the cover body to the concrete foundation via the two legs, and restrict a separating relative movement of the two legs along a placement surface of the concrete foundation when the weight of the vehicle is loaded on the bridging portion.

In accordance with another aspect, a facility protection structure includes the above-described facility protection cover and a concrete foundation. The facility protection cover is configured to be embedded together with the concrete foundation in a pavement body extending around the facility protection cover so that an upper surface of the facility protection cover forms a road surface together with an upper surface of the pavement body.

DESCRIPTION OF EMBODIMENTS

In the present disclosure, the fiber-reinforced cement composite is a material that contains at least a binder, fiber, and water, and may include fine aggregate, a water reducing agent, and a thickener.

Fiber-reinforced cement composites also include fiber-reinforced cementitious materials such as fiber-reinforced concrete (FRC). A typical example of a fiber-reinforced cement composite is ductile fiber-reinforced cement composites (DFRCC).

In the present description, the term "fiber-reinforced cement composite" is used without particularly distinguishing between a state before hydration reaction (before curing) and a state after hydration reaction (after curing).

Binders include, in addition to various cements, inorganic materials having hydraulic or latent hydraulic properties (hereinafter referred to as hydraulic materials) such as quicklime, fly ash, expanding material, blast furnace slag, silica fume, and the like.

Fibers include resin-based fibers made of polyvinyl alcohol (PVA), polyethylene (PE), polypropylene (PP) or the like, and steel fibers.

A typical example of the fiber-reinforced cement composite is DFRCC as described above. The concept of fiber-reinforced cement composite includes the engineered cement composite (ECC) and the high performance fiber-reinforced cement composite (HPFRCC). When the HPFRCC is used as the fiber-reinforced cement composite and polypropylene fibers are used as the fibers blended therein, the advantage of the embodiment of the present disclosure relating to toughness is more reliably exhibited.

The facility device to be protected includes a contactless power feeding coil capable of feeding power to a power receiving coil installed in a vehicle in a contactless manner.

Hereinafter, facility protection covers and facility protection structures using the same according to the embodiments of the present disclosure will be described with reference to the accompanying drawings.

First Embodiment

Figure 1:
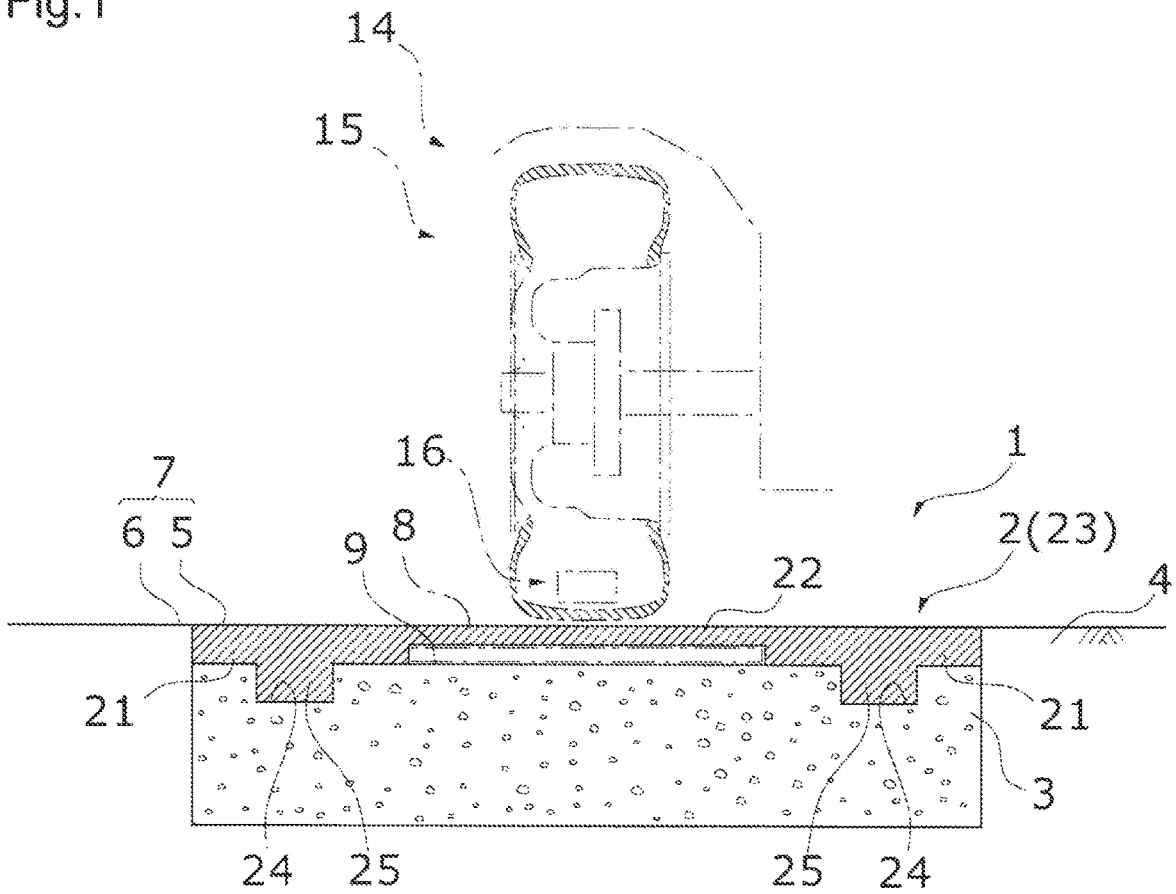
FIG. 1 is a cross-sectional view showing an arrangement of a facility protection cover according to a first embodiment and a facility protection structure using the facility protection cover.
Figure 2:
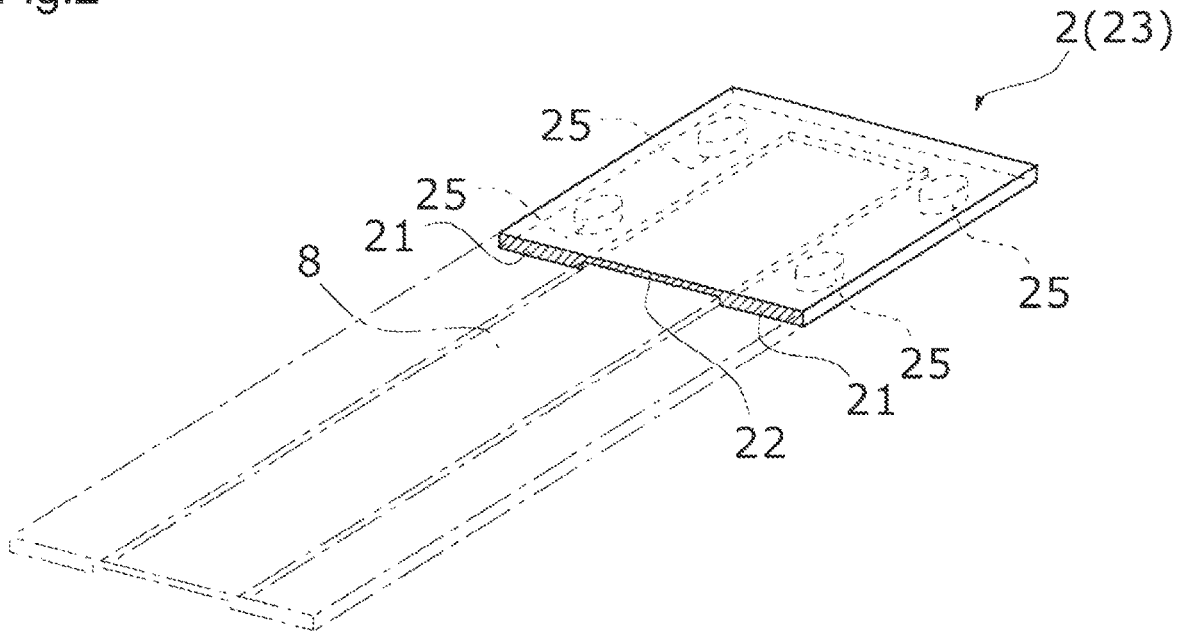
FIG. 2 is an overall perspective view of the facility protection cover shown in FIG. 1, with a portion thereof omitted.
Figure 3:
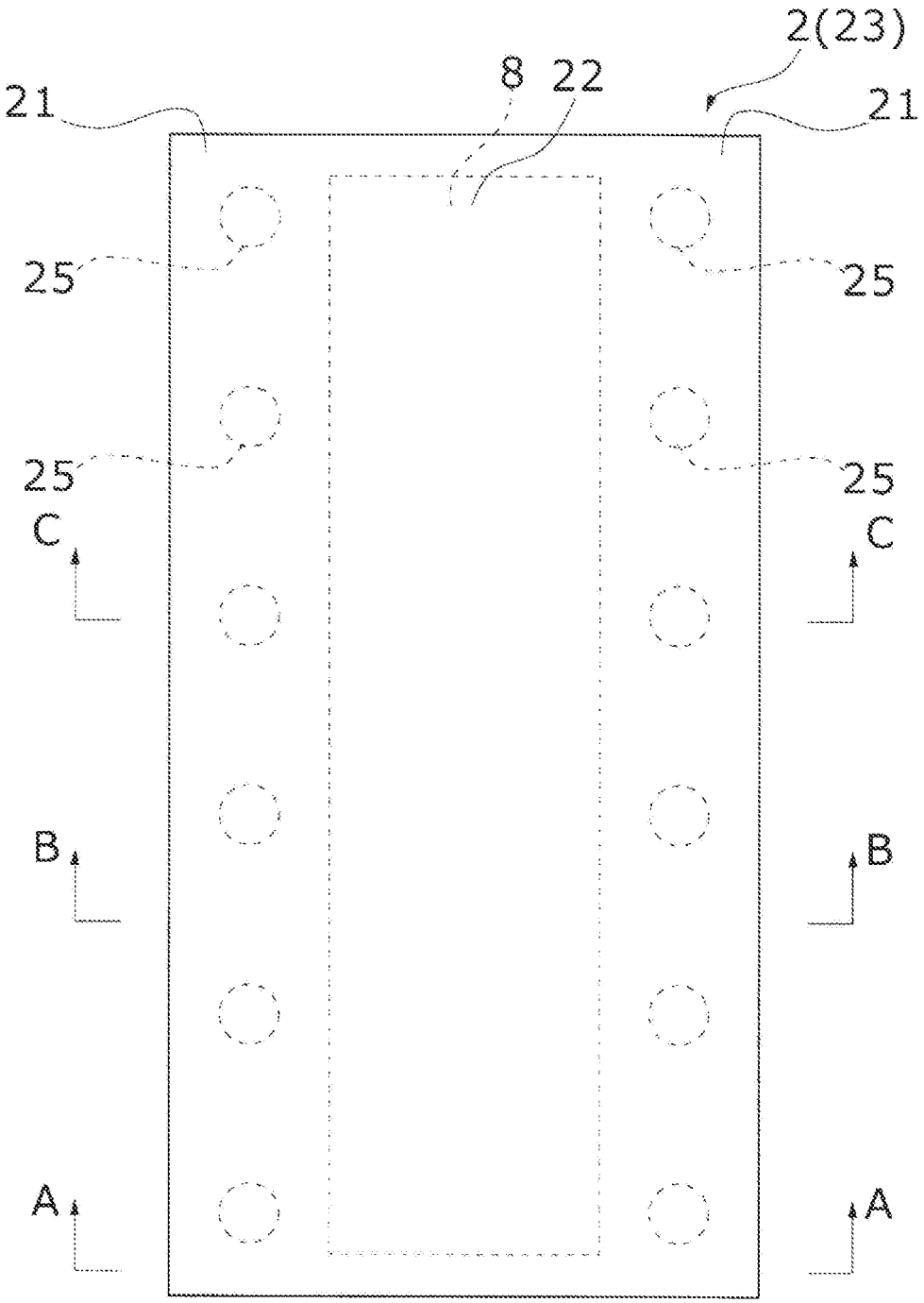
FIG. 3 is a plan view of the facility protection cover shown in FIG. 2.
Figure 4A:
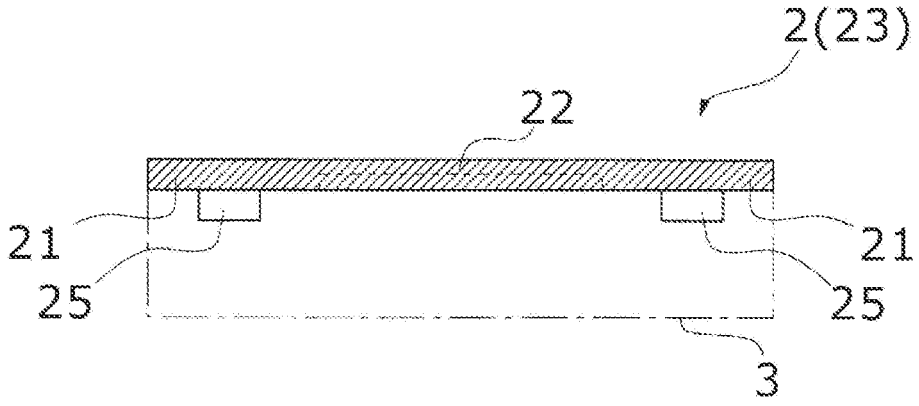
FIG. 4A is a transverse sectional view taken along line A-A in FIG. 3.
Figure 4B:
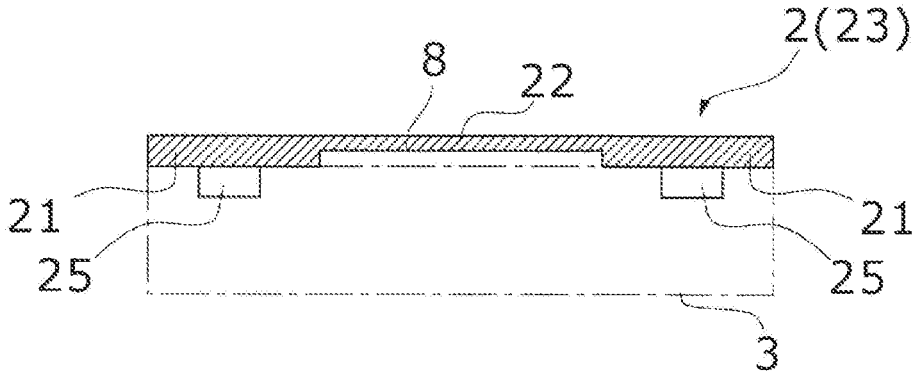
FIG. 4B is a transverse sectional view taken along line B-B in FIG. 3.
Figure 4C:
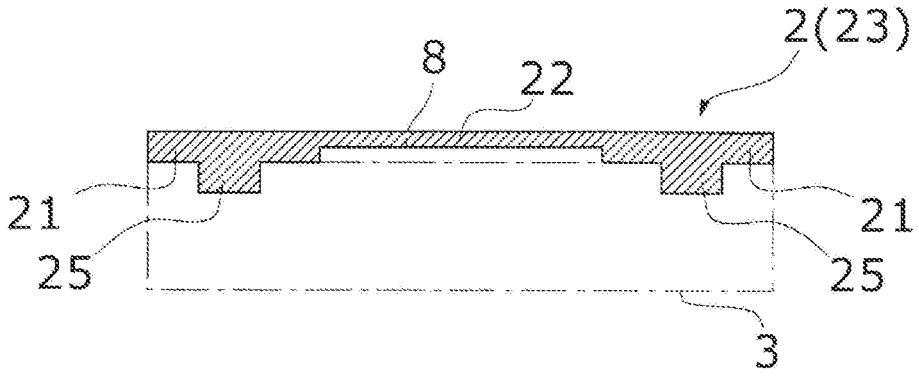
FIG. 4C is a transverse sectional view taken along line C-C in FIG. 3.

FIG. 1 is a diagram showing a facility protection structure 1 according to the present embodiment. In this facility protection structure 1, a facility protection cover 2 is embedded in a concrete pavement body 4 together with a concrete foundation 3. The facility protection cover 2 is positioned so that its upper surface 5 forms a road surface 7 with an upper surface 6 of the concrete pavement body 4 extending around the facility protection cover 2.

A facility device placement space 8 is provided between the facility protection cover 2 and the concrete foundation 3. A contactless power feeding coil (not shown) as a facility device accommodated in the facility device placement space 8 is configured to contactlessly feed power to a power receiving coil 16 installed in a tire 15 of an electric vehicle 14 (hereinafter referred to as an EV 14) as a vehicle traveling on the road surface 7. The facility protection cover 2 is disposed on the concrete foundation 3 to cover the contactless power feeding coil.

FIGS. 2 to 4D are diagrams showing the facility protection cover 2 according to the present embodiment. As can be seen from these drawings and FIG. 1, the facility protection cover 2 includes a cover body 23, which includes two legs 21 and a bridging portion 22. The two legs 21 are spaced apart from each other to be located on opposite sides of the facility device placement space 8. The bridging portion 22 bridges the two legs 21 to extend over the facility device placement space 8.

The cover body 23 is configured to transmit the weight of the EV 14 loaded thereon to the concrete foundation 3 through the two legs 21. Each of the two legs 21 includes circular protrusions 25, which serve as cover-side non-flat portions, on a surface that faces the concrete foundation 3. The concrete foundation 3 includes circular recesses 24, which serve as placement surface-side non-flat portions, in a placement surface 9. The circular protrusions 25 are engaged with the circular recesses 24. This configuration restricts a separating relative movement of the two legs 21 in a direction along the placement surface 9, typically in the horizontal direction, when the weight of the EV 14 is loaded onto the bridging portion 22.

As an example, the facility protection structure 1 can be configured to have a width (measurement in the left-right direction in FIG. 1) of about 1 m, a length (measurement in the up-down direction in FIG. 3) of about 2.2 m, and a height of the concrete foundation 3 of about 20 cm. As an example, the cover body 23 can be configured such that the bridging portion 22 has a thickness of about 25 mm, the circular protrusions 25 each have an outer diameter of about 10 cm and a height of about 5 cm, and the facility device placement space 8 has a width of about 45 cm, a length of about 1.8 m, and a height of about 25 mm.

The cover body 23 is made of a fiber-reinforced cement composite.

The fiber-reinforced cement composite can be selected from known materials. When high performance fiber-reinforced cement composite (HPFRCC) is used as the fiber-reinforced cement composite, the toughness of the cover body 23 is significantly improved, and the occurrence of cracks due to bending deformation is suppressed in the bridging portion 22.

The fibers are preferably polypropylene fibers.

The HPFRCC may be composed by adding, at an additive rate of 2.0 to 4.0% by volume, polypropylene fibers of a polyolefin-based synthetic resin having a fiber tensile strength of 270 MPa or more, a fiber diameter of 35 to 70 μm, and a fiber length of 5 to 18 mm to a matrix having a water-to-binder ratio (W/B) of 35% by weight or more and a fine aggregate-to-binder weight ratio (S/B) of 0.5 to 0.95, so that the cured HPFRCC has a mean ultimate tensile strain of 0.5% or more and an ultimate mean crack width of 0.2 mm or less under uniaxial direct tensile stress. In this case, it is desirable that the particle diameter of the fine aggregate is 1.3 mm or less and the median value thereof is 10 to 100 μm.

The binder may be selected from hydraulic materials such as cement, fly ash, and expanding material.

The HPFRCC may be composed by adding 1.0 to 2.5% by volume of polypropylene fibers having a fiber tensile strength of 270 MPa or more, a fiber diameter of 35 to 70 μm, and a fiber length of 5 to 18 mm, and 0.5 to 1.5% by volume of polyvinyl alcohol fibers composed of a polyvinyl alcohol-based synthetic resin to a matrix having a water-to-binder ratio (W/B) of 35% by weight or more and a fine aggregate-to-binder weight ratio (S/B) of 0.5 to 0.95, so that the cured HPFRCC has a mean ultimate tensile strain of 0.5% or more and an ultimate mean crack width of 0.2 mm or less under uniaxial direct tensile stress.

Figure 5A:
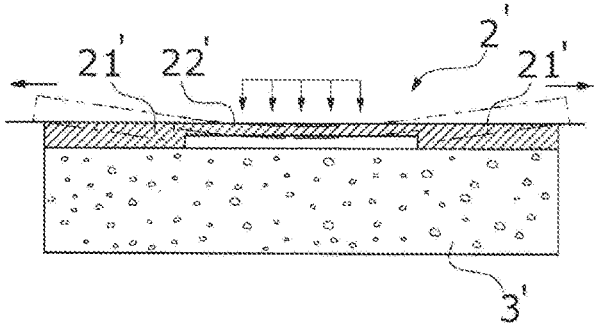
FIGS. 5A and 5B are diagrams of a comparative example in which legs of a facility protection cover are not engaged with a concrete foundation, illustrating a deformed state of the facility protection cover and a stressed state in a transverse cross section at an intermediate position.
Figure 5C:
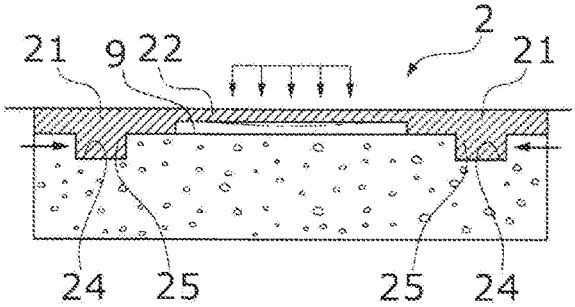
FIGS. 5C and 5D are diagrams illustrating a deformed state of the facility protection cover and a stressed state in a transverse cross section at an intermediate position in the first embodiment.
Figure 5B:
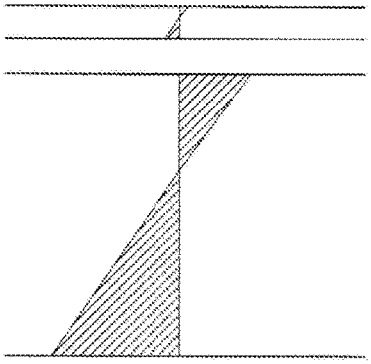
Figure 5D:
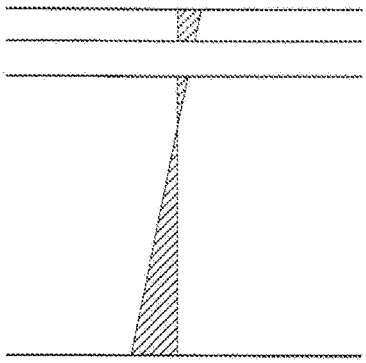

FIGS. 5A to 5D are diagrams showing operation of the facility protection cover 2 and the facility protection structure 1 using the same according to the present embodiment. FIGS. 5A and 5B are diagrams of a comparative example (legs 21' of a facility protection cover 2' are not engaged with a concrete foundation 3'), illustrating a deformed state and a stressed state in a transverse cross section at an intermediate position. FIGS. 5C and 5D are diagrams illustrating a deformed state of the facility protection cover 2 and a stressed state in a transverse cross section at an intermediate position.

First, in the comparative example (FIG. 5A), when the weight of the EV 14 is loaded on the bridging portion 22', which bridges the legs 21', tensile strain occurs in the bridging portion 22' on the tensile side in the cross section (lower parts in FIGS. 5A and 5B) as shown in FIG. 5B, bending deformation occurs as shown in FIG. 5A, and tensile strain occurs in the lower part in the cross section. As a result, the lower part in the cross section of the bridging portion 22' is extended, and the legs 21' are moved relative to each other in the direction away from each other as indicated by the arrows in FIG. 5A.

When the bridging portion 22' is relatively thin, the tensile strain at the lower part in the cross section of the bridging portion 22' is large, the deflection at an intermediate point (loading position) is large, and the loaded weight of the EV 14 reaches the facility device accommodated in the facility device placement space immediately below the bridging portion 22'.

Therefore, in the case of FIG. 5A, in addition to a concern about damage to the facility protection cover 2' and deterioration of the road surface function accompanying the damage, there is also a concern about damage to the facility device due to the loaded weight of the EV 14 acting on the facility device via the bridging portion 22'.

The loaded weight of the EV 14 is also applied to the concrete foundation 3' via the facility device, and similar strain is generated in the concrete foundation 3'.

In contrast, in the case of the present embodiment, in which the legs 21 of the facility protection cover 2 are engaged with the concrete foundation 3 (FIG. 5C), when the weight of the EV 14 is loaded on the bridging portion 22, tensile strain is similarly generated in the bridging portion 22 at the lower part in the cross section thereof, which acts to spread the legs 21 in a direction away from each other. However, the engagement of the circular protrusions 25 and the circular recesses 24 prevents the above-mentioned tensile strain, which should be originally generated, from being generated. Therefore, a compressive force against the above-described spreading force acts as a reaction force from the circular recesses 24 to the circular protrusions 25 (see arrows in FIG. 5C).

Accordingly, in the bridging portion 22, generation of tensile strain is suppressed, and conversely, compressive strain occurs. This, following the same principle as in prestressed structures, not only restricts bending deformation, but also reduces deflection. Therefore, the loaded weight of the EV 14 does not reach the facility device accommodated in the facility device placement space immediately below the bridging portion 22 to damage the facility device.

In the case of the present embodiment, the engagement of the circular recesses 24 and the circular protrusions 25 causes the facility protection cover 2 and the concrete foundation 3 to move integrally in response to the loaded weight of the EV 14. The present embodiment is thus different from the case of FIGS. 5A and 5B, in which the facility protection cover 2 and the concrete foundation 3 move independently in bending. As shown in FIG. 5D, the cross-sectional stresses are compressive over the entire cross-section of the bridging portion 22.

Figure 6A:
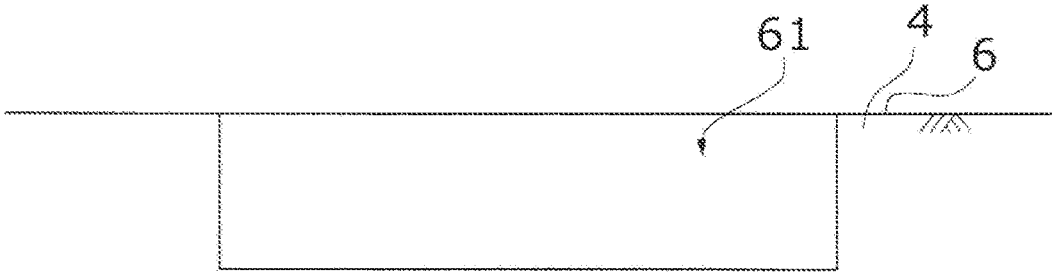
FIGS. 6A to 6D are diagrams showing a construction procedure of the facility protection structure shown in FIG. 1.

In order to construct the facility protection structure 1 using the facility protection cover 2 according to the present embodiment, the concrete pavement body 4 is first dug down from the upper surface 6 to form an installation space 61 as shown in FIG. 6A.

When the facility protection structure 1 is constructed simultaneously with the construction of the concrete pavement body 4, the installation space 61 may be formed by using a formwork or the like.

Figure 6B:
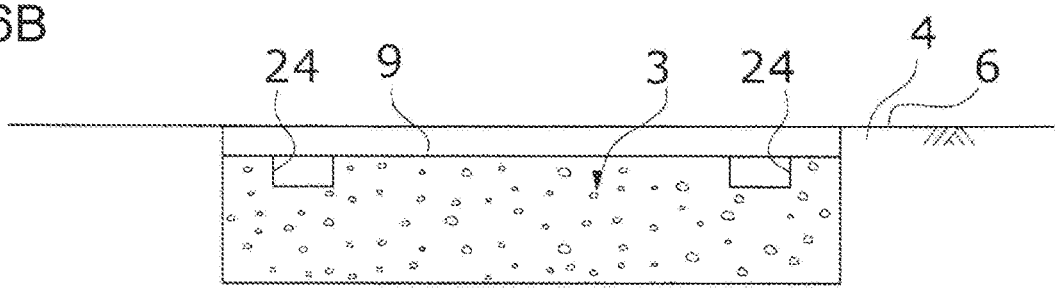

Next, the concrete foundation 3 is constructed in the installation space 61 (FIG. 6B).

The concrete foundation 3 may be constituted by using normal-weight concrete or the like. At the time of construction, the circular recesses 24 are formed on the placement surface 9 by means such as a block-out.

Figure 6C:
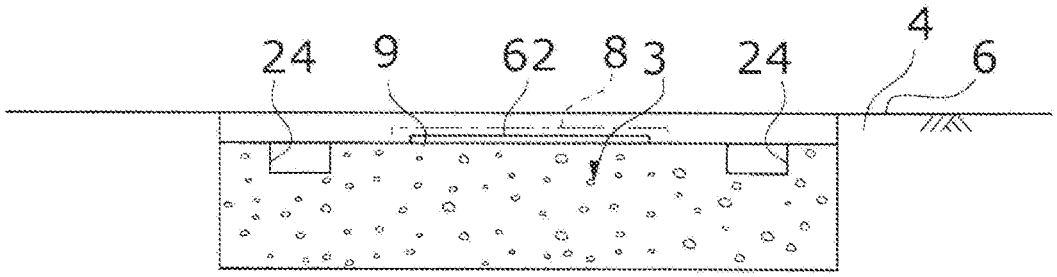

After the elapse of an appropriate curing period, contactless power feeding coils 62 as the facility devices are installed in the facility device placement space 8 provided on the placement surface 9 of the concrete foundation 3 (FIG. 6C).

Figure 6D:
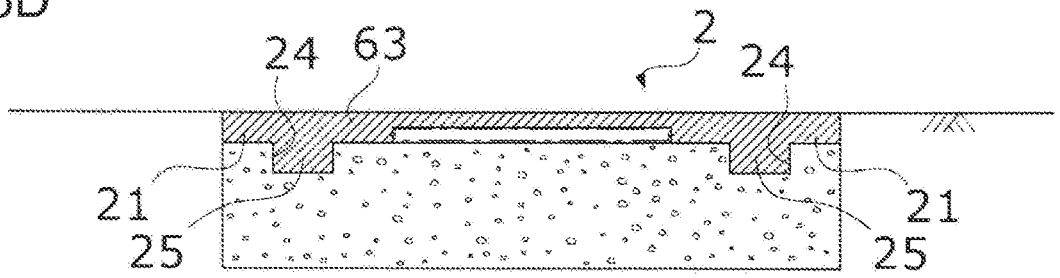

Next, a fiber-reinforced cement composite 63 is placed on the concrete foundation 3 to form the facility protection cover 2 (the cover body 23), and the construction of the facility protection structure 1 is completed (FIG. 6D).

When placing the fiber-reinforced cement composite 63, care should be taken to ensure that the fiber-reinforced cement composite 63 properly fills the circular recesses 24 provided in the placement surface 9 of the concrete foundation 3.

As described above, the facility protection cover 2 and the facility protection structure 1 using the same according to the present embodiment are configured such that the facility protection cover 2 is embedded in the concrete pavement body 4 together with the concrete foundation 3 so that the upper surface 5 of the facility protection cover 2 forms the road surface 7 together with the upper surface 6 of the concrete pavement body 4, which extends around the facility protection cover 2. Also, the cover body 23 is made of the fiber-reinforced cement composite 63. Therefore, favorable tensile strength characteristics of the fiber-reinforced cement composite 63 are exhibited, improving the toughness of the bridging portion 22 and reducing bending deformation.

Since there is no possibility that excessive bending cracks or bending deflections occur in the bridging portion 22, the road surface functions for traveling vehicles and the protective function for the contactless power feeding coils 62 are maintained without increasing the thickness of the bridging portion 22. Since it is not necessary to increase the thickness of the bridging portion 22, the power feeding efficiency to the power receiving coil 16 is ensured.

In particular, in the present embodiment, the separating relative movement of the two legs 21 along the placement surface 9 of the concrete foundation 3 is restricted by the engagement of the circular protrusions 25 and the circular recesses 24. Therefore, even when the weight of the EV 14 is loaded on the bridging portion 22, the above-described tensile strain, which should be originally generated in the lower part in the cross section, is not generated in the bridging portion 22. Therefore, a compressive force acts from the opposite sides via the two legs 21.

Accordingly, in the bridging portion 22, generation of tensile strain due to bending deformation is suppressed, and conversely, compressive strain occurs, due to the same principle as in prestressed structures. This configuration improves the road surface function for traveling vehicles and the protective function for the contactless power feeding coils 62 as described above, while reducing the thickness of the bridging portion 22. The configuration further improves the power feeding efficiency to the power receiving coil 16.

Figure 7A:
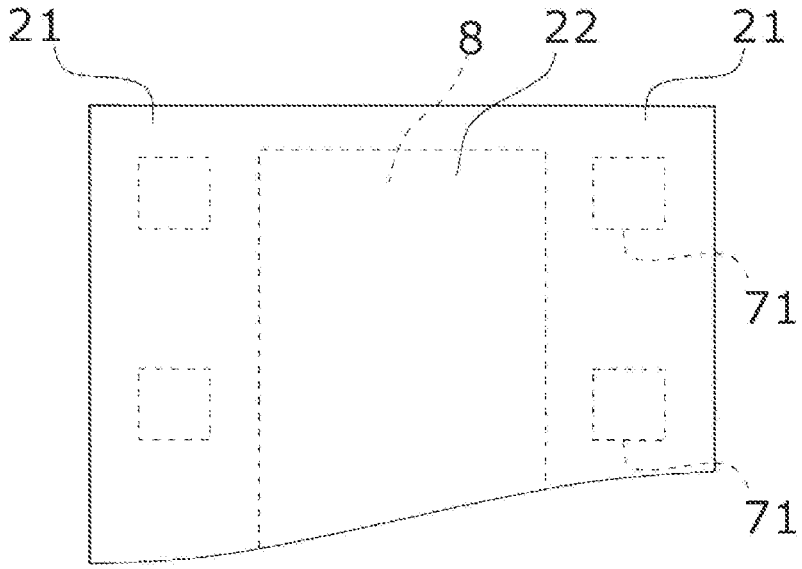
FIGS. 7A and 7B are partial plan views respectively showing modifications of the first embodiment.
Figure 7B:
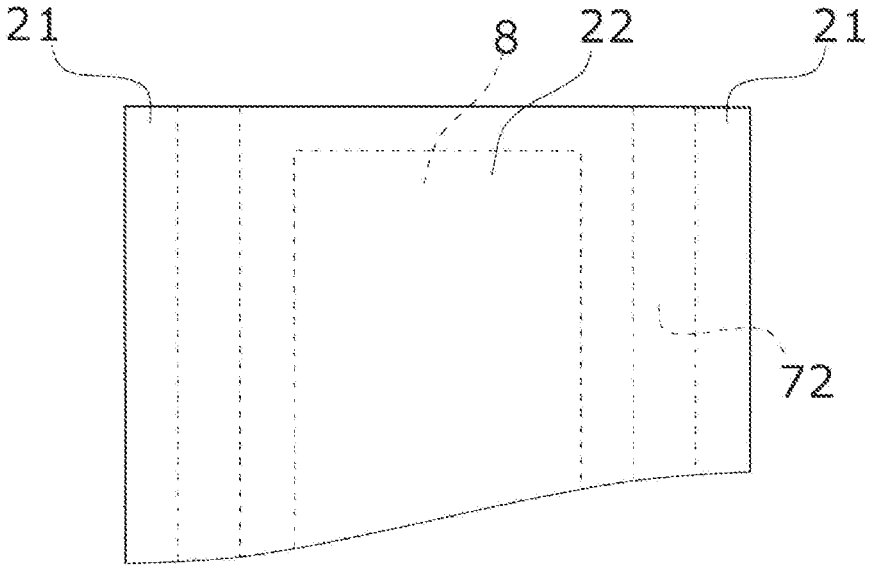

In the present embodiment, the cover-side non-flat portion includes the circular protrusions 25 on the assumption that the placement surface-side non-flat portions includes the circular recesses 24. However, the cover-side non-flat portion may have any structure in correspondence with the placement surface-side non-flat portion. For example, if the placement surface-side non-flat portion includes rectangular recesses, the cover-side non-flat portion may include rectangular protrusions 71, which engage with the rectangular recesses, as shown in FIG. 7A. If the placement surface-side non-flat portion includes a groove, the cover-side non-flat portion may include a ridge 72, which engages with the groove, as shown in FIG. 7B.

Typically, one of the cover-side non-flat portion and the placement surface-side non-flat portion is a recess, and the other is a protrusion. However, each of the cover-side non-flat portion and the placement surface-side non-flat portion may have wavy or sawtooth shapes.

In a case in which the placement surface-side non-flat portion is an exposed protrusion of a shear resistance member such as a cotter, a stud, a bolt, or a pin used as a shear key, the cover-side non-flat portion includes a recess formed to be fitted with the exposed protrusion. When the placement surface-side non-flat portion includes a recess, the cover-side non-flat portion includes an exposed protrusion of the shear resistance member configured to be fitted into the recess as described above.

Conventionally, a shear key is known as a means for restricting relative movement of two members adjacent to each other when the two members move relative to each other along a boundary surface between the two members. Such a shear key is employed on the assumption that the load acting on the two members is parallel to the boundary surface. In contrast, in the structure according to the present embodiment, the cover-side non-flat portion is configured to engage with the placement surface-side non-flat portion, which is provided on the placement surface, and the cover-side non-flat portion is provided on the side of the two legs that faces the concrete foundation. This structure is made on the assumption that the vehicle weight acts on it, that is, on the assumption that the load acts in the direction orthogonal to the placement surface, which is the boundary surface, and is essentially different from the conventional shear key.

Figure 8A:
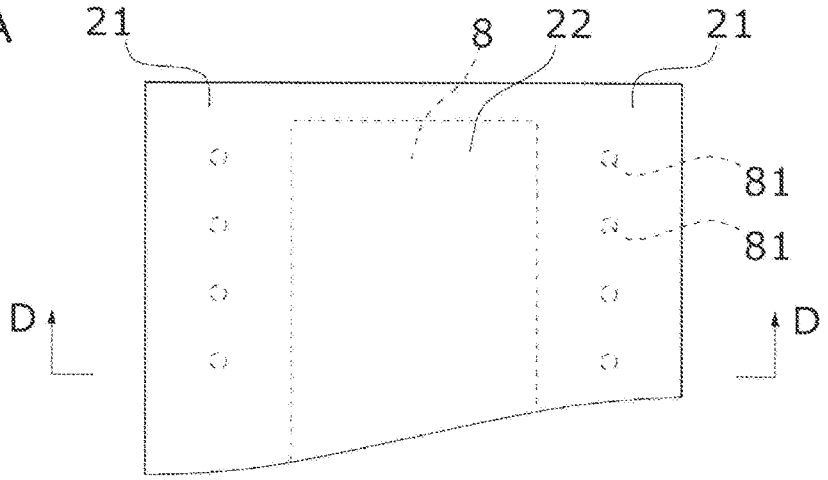
FIG. 8A is a partial plan view of a modification of the first embodiment.
Figure 8B:
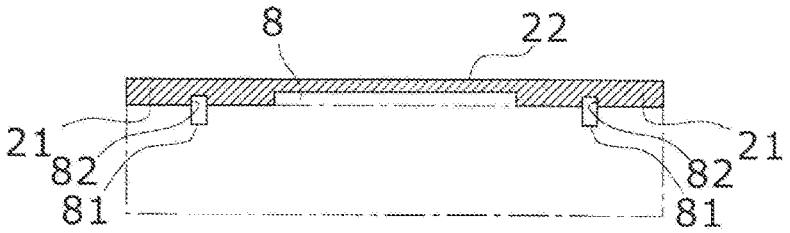
FIG. 8B is a transverse sectional view taken along line D-D in FIG. 8A.

Further, the placement surface-side non-flat portion and the cover-side non-flat portion do not necessarily need to be formed continuously and integrally with the concrete foundation and the cover body, respectively. For example, in a case in which the placement surface-side non-flat portion includes exposed protrusions of engaging pins 81 as shown in FIGS. 8A and 8B, the cover-side non-flat portion may include recesses 82, which are formed to receive the exposed protrusions. The engaging pins 81 are formed such that the length of the exposed protrusions is smaller than the thickness of the legs 21 and the length of the embedded portions is smaller than the thickness of the concrete foundation 3.

In this modification, when the cover-side non-flat portion includes the exposed protrusion of the engaging pins 81, the placement surface-side non-flat portion can be regarded as a case in which the recesses 82 formed to receive the exposed protrusions.

Figure 8C:
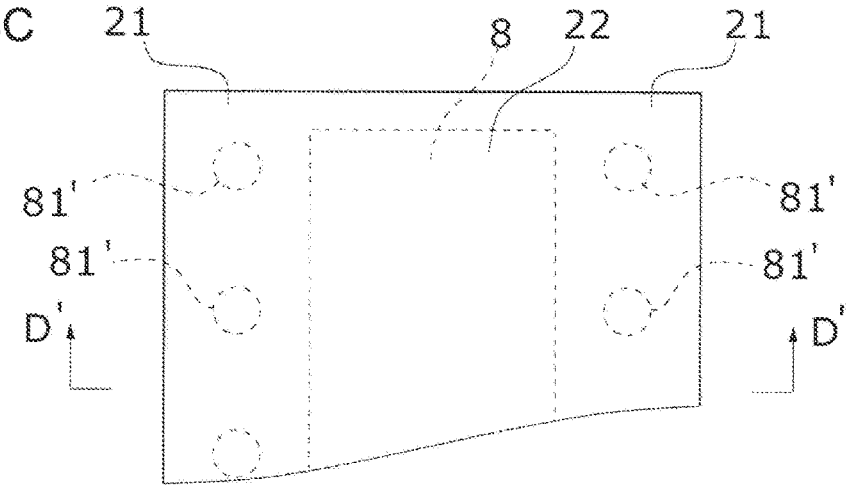
FIG. 8C is a partial plan view of another modification of the first embodiment.
Figure 8D:
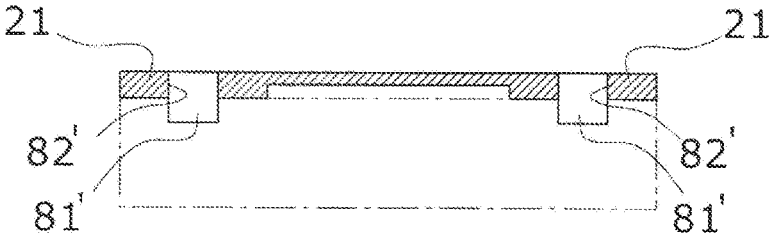
FIG. 8D is a transverse sectional view taken along line D'-D' in FIG. 8C.

In place of the engaging pins 81, cast-in-place shear keys 81' may be employed as shown in FIGS. 8C and 8D. When the placement surface-side non-flat portion includes the exposed protrusions of the cast-in-place shear keys 81', the cover-side non-flat portion may include through-holes 82' serving as recesses for receiving the exposed protrusions.

The cast-in-place shear keys 81' can be installed by pouring the fiber-reinforced cement composite 63 into recesses previously provided in the concrete foundation and the through-holes 82' provided in the facility protection cover after the concrete foundation and the facility protection cover are constructed.

Further, in the present embodiment, it is assumed that the facility protection cover is manufactured on site, but instead of this, as shown in FIGS. 9A to 9D, it is possible to use a facility protection cover 92 manufactured as a precast concrete member.

Figure 9A:
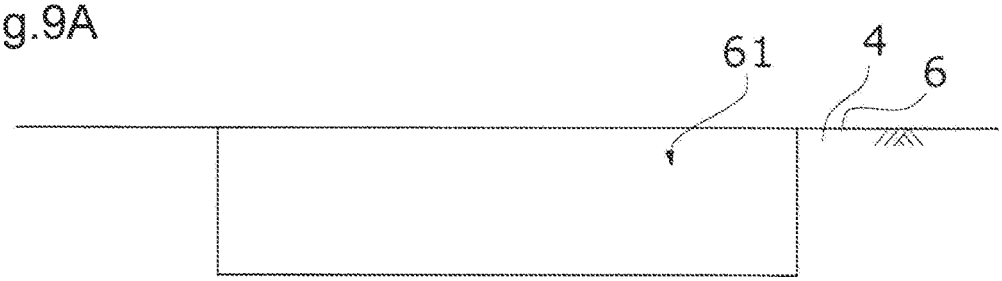
FIGS. 9A to 9D are diagrams showing a construction procedure of a facility protection structure using a facility protection cover according to another modification of the first embodiment.
Figure 9B:
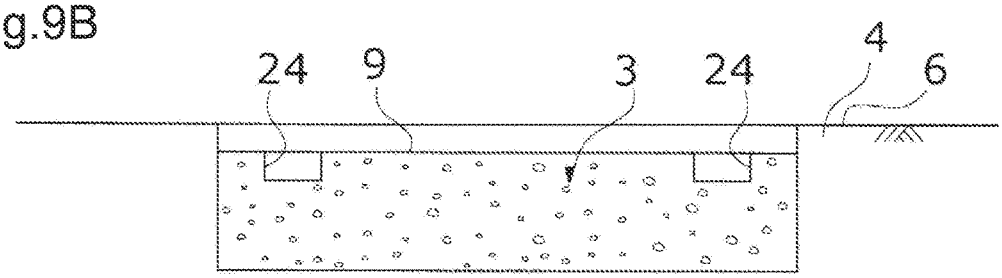
Figure 9C:
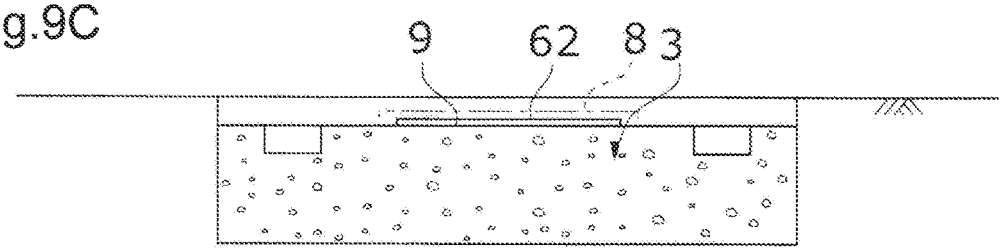
Figure 9D:
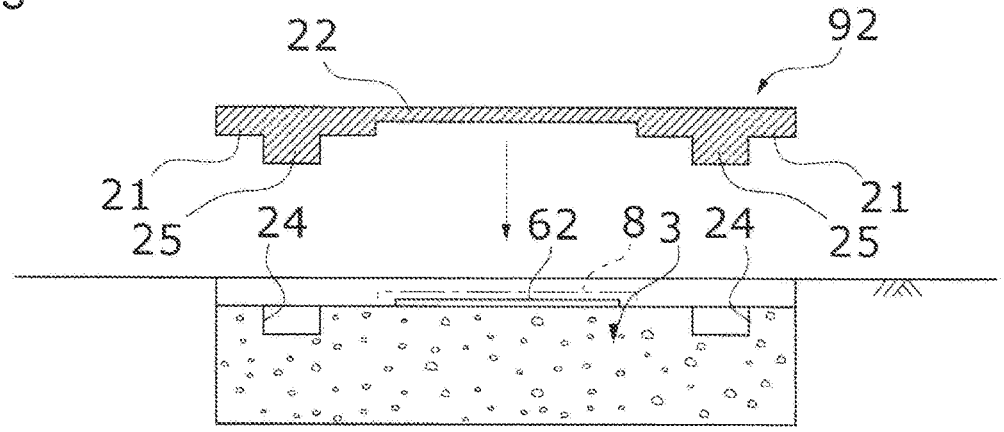

In such a modification, first, an installation space 61 is formed by digging down the concrete pavement body 4 from the upper surface 6 (FIG. 9A). Then the concrete foundation 3 is constructed in the installation space 61 (FIG. 9B). Next, the contactless power feeding coils 62, which are facility devices, are installed in the facility device placement space 8 provided on the placement surface 9 of the concrete foundation 3 (FIG. 9C). Thereafter, the facility protection cover 92 is superposed on the concrete foundation 3 (FIG. 9D).

When the facility protection cover 92 is superposed on the concrete foundation 3, the circular protrusions 25 as the cover-side non-flat portion may be fitted into the circular recesses 24 as the placement surface-side non-flat portion provided on the placement surface 9 of the concrete foundation. For example, it is preferable that the circular recesses 24 be formed to be slightly larger than the circular protrusions 25, and a grout material be injected into gaps between the circular recesses 24 and the circular protrusions 25 at the time of fitting so that the circular protrusions 25 are reliably engaged with the circular recesses 24.

In the present embodiment, the facility devices are the contactless power feeding coils 62. However, as long as the facility device is to be protected from the load of a vehicle traveling on the road surface, the facility device can be any device. For example, the facility device may be a communication device.

Figure 10:
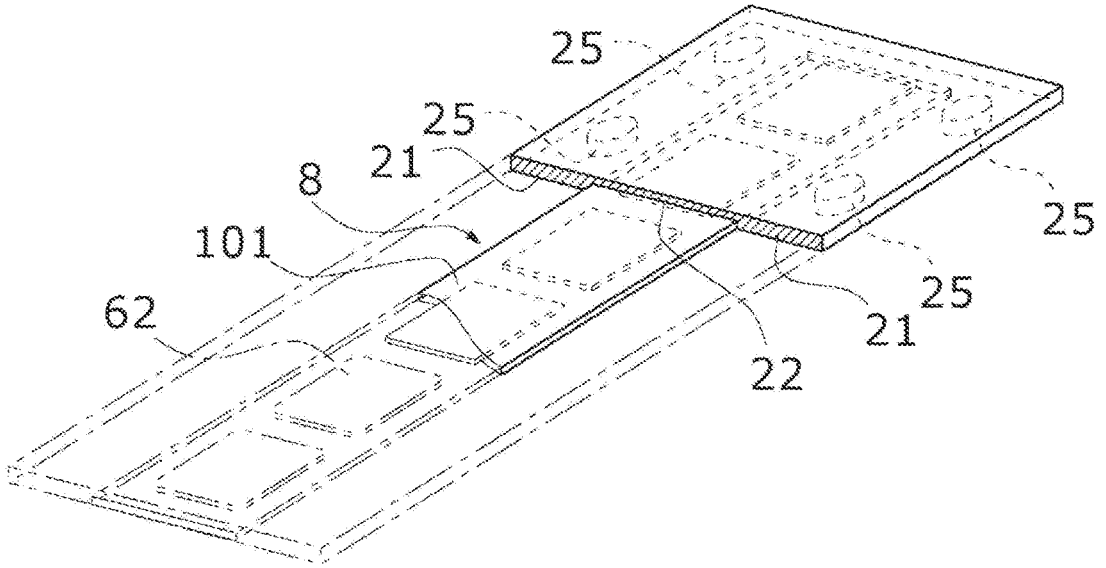
FIG. 10 is an overall perspective view of a facility protection cover according to another modification of the first embodiment, with a portion thereof omitted.

In addition, although not particularly mentioned in the present embodiment, the facility device may be arranged in the facility device placement space in any state. If direct embedment in concrete is possible, the facility device may be arranged in an exposed state in the facility device placement space. As shown in FIG. 10, the contactless power feeding coils 62 may be arranged in the facility device placement space 8 by arranging the contactless power feeding coils 62 in an accommodating case 101.

Second Embodiment

Next, a facility protection cover and a facility protection structure using the same according to a second embodiment will be described with reference to the accompanying drawings. Like or the same reference numerals are given to those components that are substantially the same as the corresponding components of the first embodiment and detailed explanations are omitted.

Figure 11:
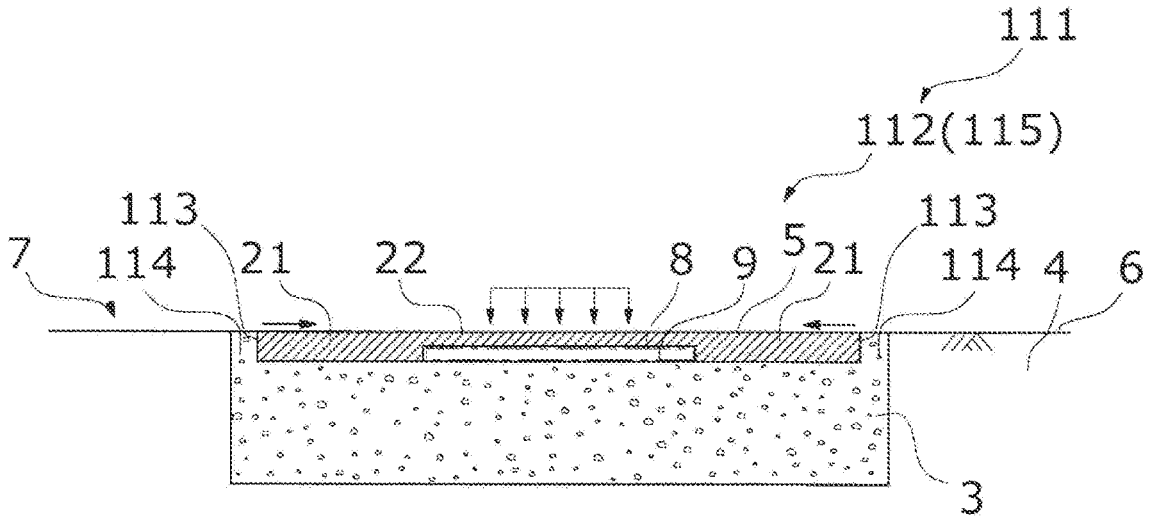
FIG. 11 is a cross-sectional view showing a facility protection cover according to a second embodiment and a facility protection structure using the facility protection cover.

In a facility protection structure 111 according to the present embodiment, a facility protection cover 112 is embedded in a concrete pavement body 4 together with a concrete foundation 3 as shown in FIG. 11. The facility protection cover 112 is positioned so that its upper surface 5 forms a road surface 7 with an upper surface 6 of the concrete pavement body 4 extending around the facility protection cover 112.

A facility device placement space 8 is provided between the facility protection cover 112 and the concrete foundation 3. A contactless power feeding coil (not shown) as a facility device accommodated in the facility device placement space 8 is configured to contactlessly feed power to the power receiving coil 16, which has been described in the first embodiment. The facility protection cover 112 is disposed on a placement surface 9 of the concrete foundation 3 to cover the contactless power feeding coil.

The facility protection cover 112 includes a cover body 115, which includes two legs 21 and a bridging portion 22. The two legs 21 are spaced apart from each other to be located on opposite sides of the facility device placement space 8. The bridging portion 22 bridges the two legs 21 to extend over the facility device placement space 8. The cover body 115 is configured to transmit the weight of the EV 14 loaded on the cover body 115 to the concrete foundation 3 through the two legs 21.

The cover body 115 is configured such that the two legs 21 respectively include edge-side surfaces 113 on far sides. Each edge-side surface 113 comes into contact with a shoulder portion 114 protruding from the placement surface 9. This configuration restricts a separating relative movement of the two legs 21 in a direction along the placement surface 9, typically in the horizontal direction, when the weight of the EV 14 is loaded onto the bridging portion 22.

The shoulder portion 114 may be formed so as to be continuously integrated with the concrete foundation 3 as a part of the concrete foundation 3.

The cover body 115 is made of a fiber-reinforced cement composite in the same manner as described in the first embodiment.

In the facility protection cover 112 according to the present embodiment, when the weight of the EV 14 is loaded on the bridging portion 22, tensile strain is similarly generated in the bridging portion 22 at the lower part in the cross section thereof, which acts to spread the legs 21 in a direction away from each other. However, the movement limiting action of the shoulder portions 114 prevents the above-mentioned tensile strain, which should be originally generated, from being generated. Therefore, a compressive force against the above-described spreading force acts as a reaction force from the shoulder portions 114 to the edge-side surfaces 113 of the two legs 21 (see arrows in FIG. 11).

Accordingly, in the bridging portion 22, generation of tensile strain is suppressed, and conversely, compressive strain occurs. This, following the same principle as in prestressed structures, restricts bending deformation. The loaded weight of the EV 14 is reliably transmitted to the concrete foundation 3 through the legs 21, and deflection due to bending deformation is reduced. Therefore, the loaded weight of the EV 14 does not reach the facility device accommodated in the facility device placement space immediately below the bridging portion 22.

As described above, the facility protection cover 112 and the facility protection structure 111 using the same according to the present embodiment are configured such that the facility protection cover 112 is embedded in the concrete pavement body 4 together with the concrete foundation 3 so that the upper surface 5 of the facility protection cover 112 forms the road surface 7 together with the upper surface 6 of the concrete pavement body 4, which extends around the facility protection cover 112. Also, the cover body 115 is made of a fiber-reinforced cement composite. Therefore, favorable tensile strength characteristics of the fiber-reinforced cement composite are exhibited, improving the toughness of the bridging portion 22 and reducing bending deformation.

Since there is no possibility that excessive bending cracks or bending deflections occur in the bridging portion 22, the road surface functions for traveling vehicles and the protective function for the contactless power feeding coils 62 are maintained without increasing the thickness of the bridging portion 22. Since it is not necessary to increase the thickness of the bridging portion 22, the power feeding efficiency to the power receiving coil 16 is ensured.

In particular, the separating relative movement of the two legs 21 along the placement surface 9 of the concrete foundation 3 is restricted by the movement limiting action of the shoulder portions 114. Therefore, even when the weight of the EV 14 is loaded on the bridging portion 22, the above-described tensile strain, which should be originally generated in the lower part in the cross section, is not generated in the bridging portion 22. Therefore, a compressive force acts from the opposite sides via the shoulder portions 114.

Accordingly, in the bridging portion 22, generation of tensile strain due to bending deformation is suppressed, and conversely, compressive strain occurs, due to the same principle as in prestressed structures. This configuration improves the road surface function for traveling vehicles and the protective function for the contactless power feeding coils 62 as described above, while reducing the thickness of the bridging portion 22. The configuration further improves the power feeding efficiency to the power receiving coil 16.

In the present embodiment, it is assumed that the facility protection cover is manufactured on site, but instead of this, it is possible to use a facility protection cover manufactured as a precast concrete member, as in the first embodiment.

In such a modification, when a precast facility protection cover is superposed on the concrete foundation 3, it is desirable that the distance between the shoulder portions 114 be slightly larger than the entire width of the facility protection cover, and a grout material is injected into gaps between the edge-side surfaces of the legs of the facility protection cover and the shoulder portions 114 so that the edge-side surfaces of the legs of the facility protection cover reliably abut the shoulder portions 114.

In the present embodiment, the facility devices are the contactless power feeding coils 62. However, as long as the facility device is to be protected from the load of a vehicle traveling on the road surface, the facility device can be any device. For example, the facility device may be a communication device.

In addition, although not particularly mentioned in the present embodiment, the facility device may be arranged in the facility device placement space in any state. If direct embedment in concrete is possible, the facility device may be arranged in an exposed state in the facility device placement space. Also, as in the first embodiment, the contactless power feeding coils 62 may be arranged in the facility device placement space 8 by arranging the contactless power feeding coil 62 in an accommodating case 101.

Third Embodiment

Next, a facility protection cover and a facility protection structure using the same according to a third embodiment will be described with reference to the accompanying drawings. Like or the same reference numerals are given to those components that are substantially the same as the corresponding components of the first or second embodiment and detailed explanations are omitted.

Figure 12:
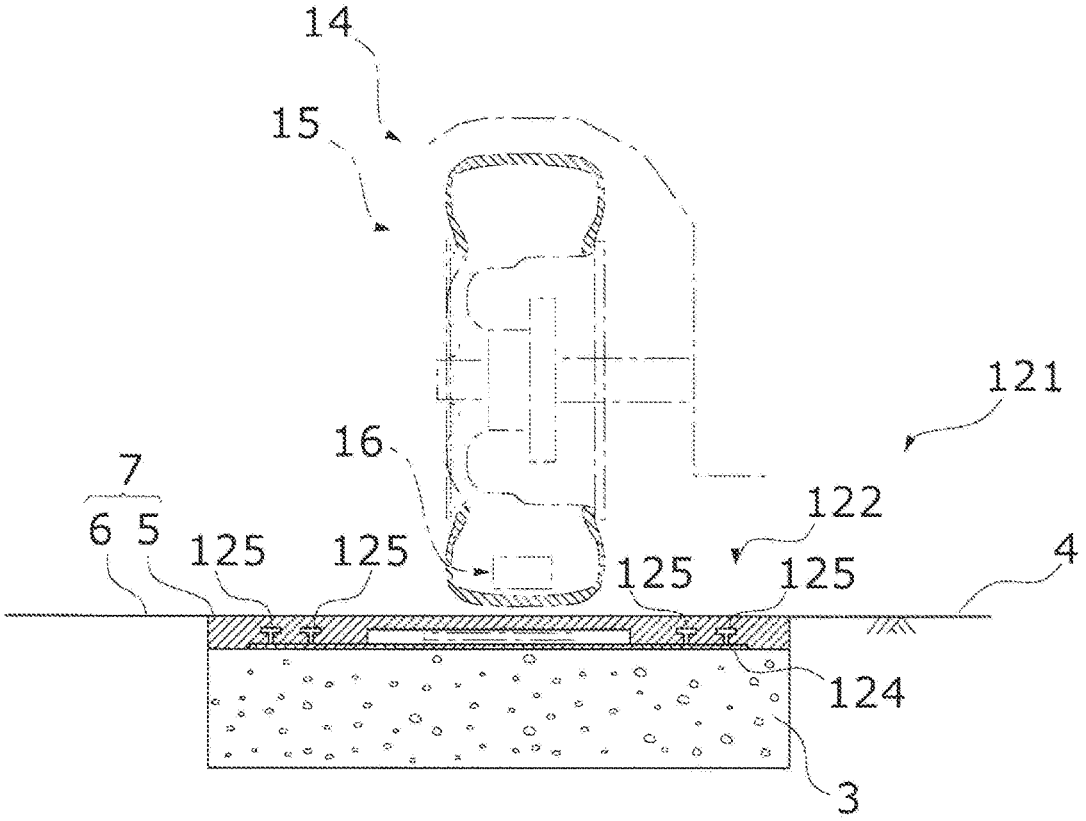
FIG. 12 is a cross-sectional view showing an arrangement of a facility protection cover according to a third embodiment and a facility protection structure using the facility protection cover.
Figure 13:
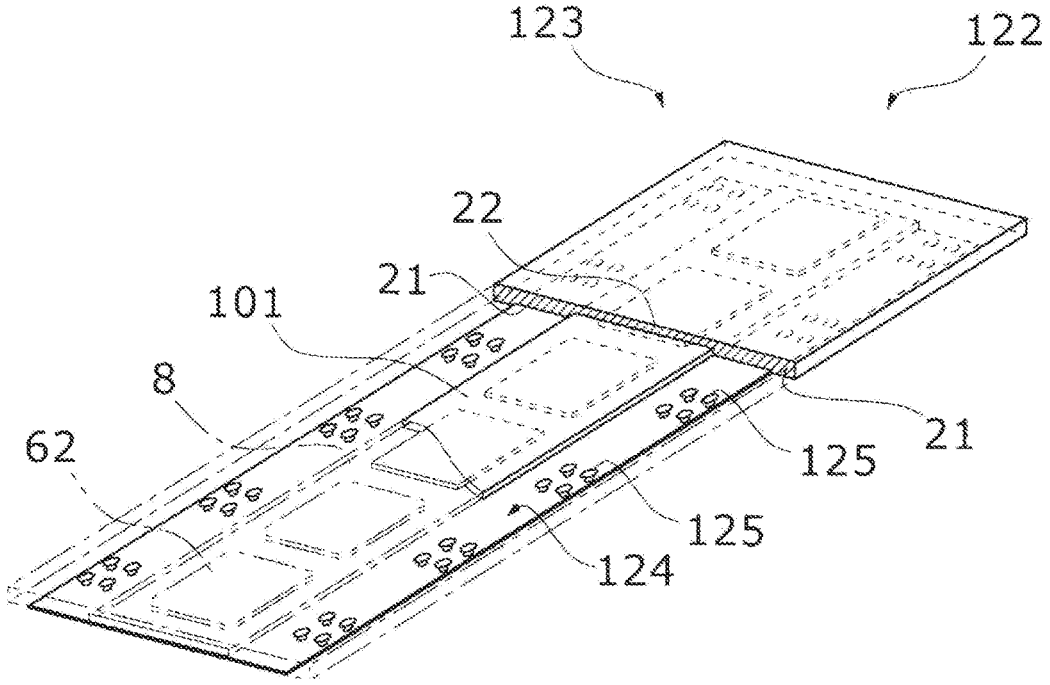
FIG. 13 is an overall perspective view of the facility protection cover shown in FIG. 12, with a portion thereof omitted.
Figure 14:
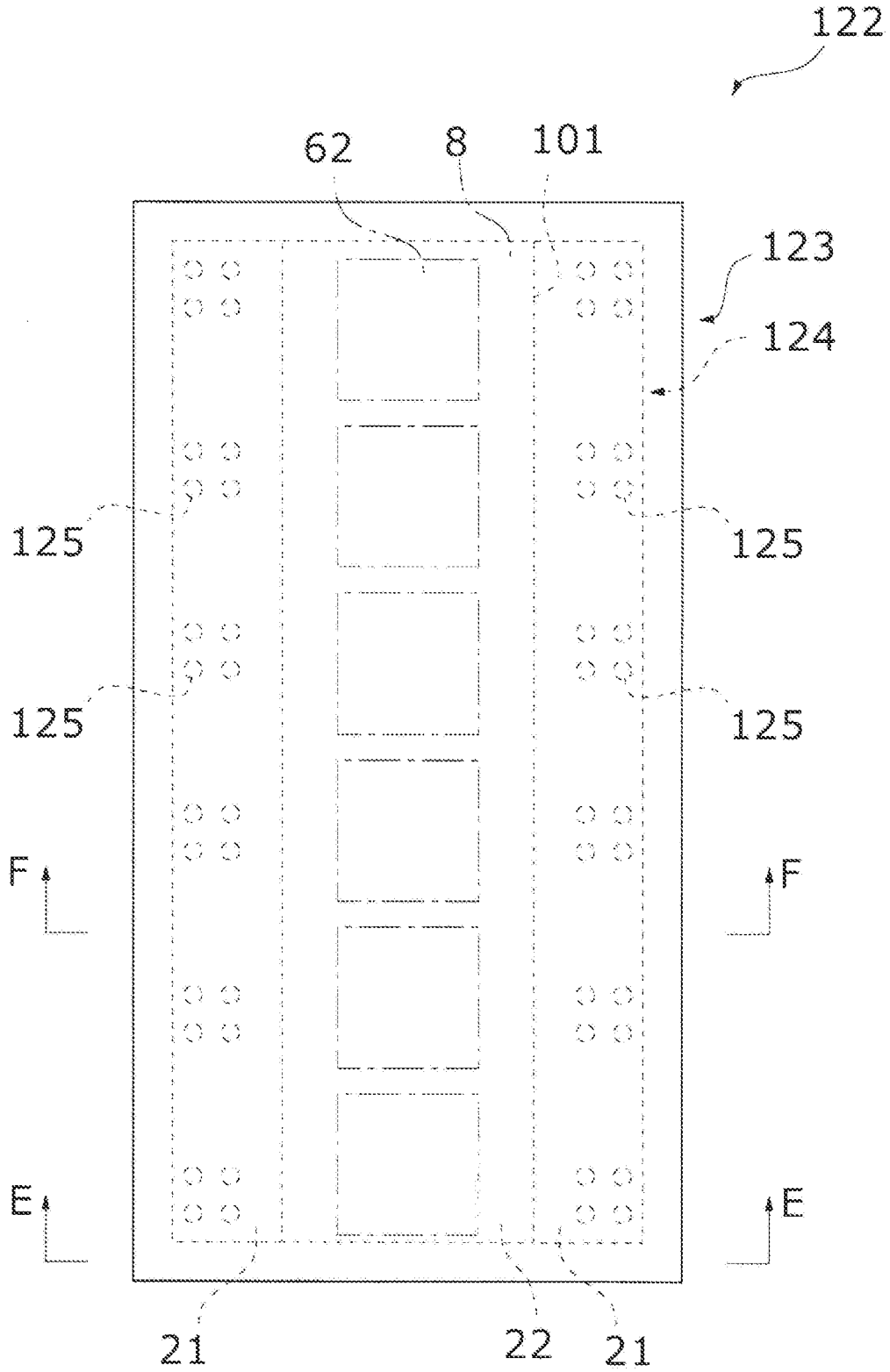
FIG. 14 is a plan view of the facility protection cover shown in FIG. 13.
Figure 15A:
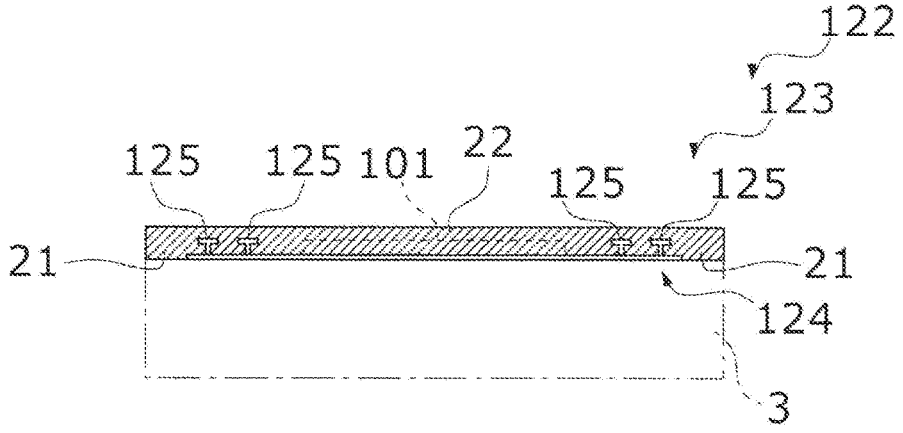
FIG. 15A is a transverse sectional view taken along line E-E in FIG. 14.
Figure 15B:
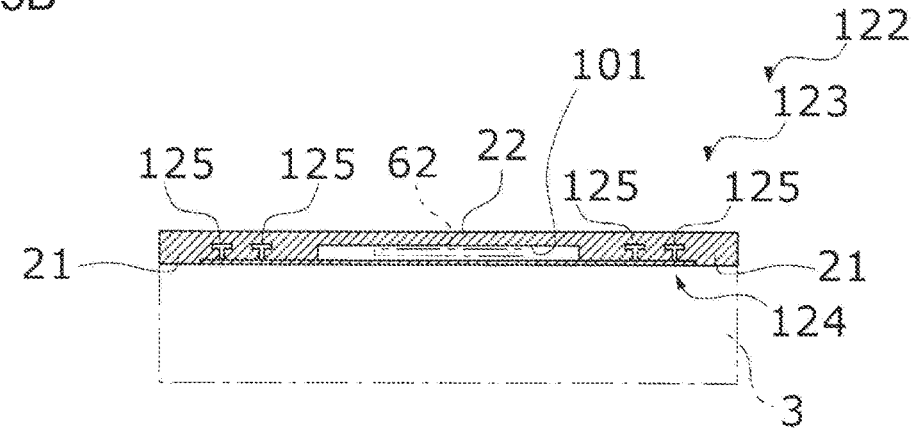
FIG. 15B is a transverse sectional view taken along line F-F in FIG. 14.

FIG. 12 is a diagram showing a facility protection structure according to the present embodiment. In a facility protection structure 121, a facility protection cover 122 is embedded in a concrete pavement body 4 together with a concrete foundation 3. The facility protection cover 122 is positioned so that its upper surface 5 forms a road surface 7 with an upper surface 6 of the concrete pavement body 4 extending around the facility protection cover 122.

FIGS. 13 to 15B are diagrams showing the facility protection cover 122 according to the present embodiment. As can be seen from these drawings and FIG. 12, the facility protection cover 122 includes a cover body 123, which includes two legs 21 and a bridging portion 22, and a tension resisting plate 124. The two legs 21 are spaced apart from each other. The bridging portion 22 bridges the two legs 21. The tension resisting plate 124 serves as tension resisting means displaced on surfaces of the two legs 21 that face the concrete foundation.

An accommodating case 101 is disposed in a space surrounded by the legs 21, the bridging portion 22, and the tension resisting plate 124, such that an outer peripheral surface of the accommodating case 101 is in contact with the bridging portion 22 and the tension resisting plate 124. The internal space of the accommodating case 101 functions as a facility device placement space 8 for accommodating the facility device. The two legs 21 are spaced apart from each other to be located on opposite sides of the facility device placement space 8. The bridging portion 22 bridges the two legs 21 to extend over the facility device placement space 8.

Contactless power feeding coils 62 as facility devices accommodated in the facility device placement space 8, which is the internal space of the accommodating case 101, are configured to contactlessly feed power to a power receiving coil 16 installed in a tire 15 of an EV 14 as a vehicle traveling on the road surface 7. The facility protection cover 122 is disposed on the concrete foundation 3 to cover the contactless power feeding coils with the cover body 123.

The cover body 123 is configured to transmit the weight of the EV 14 loaded thereon to the concrete foundation 3 through the two legs 21 and optionally the tension resisting plate 124. The tension resisting plate 124 is coupled to the two legs 21 by embedding, in the two legs 21, studs 125 as fixing portions protruding from the cover side (i.e., the side facing the cover body 123) of the tension resisting plate 124. This configuration restricts a separating relative movement of the two legs 21 in a direction along the placement surface 9 of the concrete foundation 3, typically in the horizontal direction, when the weight of the EV 14 is loaded onto the bridging portion 22.

The tension resisting plate 124 is preferably formed of a conductive material, particularly a nonmagnetic conductive material. Such a material can be selected from metals such as aluminum and copper. In the present embodiment, the tension resisting plate 124 is formed by an aluminum plate.

Considering the fact that a typical reinforcing bar arrangement in a reinforced concrete (RC) slab is a configuration in which D13 reinforcing bars are arranged at a 100 mm pitch, the tensile rigidity EA of the RC slab is represented by the following expression.

$$EA=200\ kN/mm^2\times126.7\ mm^2\times10\ bars/m=253\times10^3\ kN$$

When the tension resisting plate 124 made of an aluminum plate is 3 mm thick, its tensile rigidity is expressed by the following expression.

$$EA=70\ kN/mm^2\times3\ mm\times1000\ mm=210\times10^3\ kN$$

That is, if the tension resisting plate 124 is made to have a thickness of approximately 3 mm, the tension resisting plate 124 has a tensile rigidity equivalent to that of the typical RC slab.

The cover body 123 is made of a fiber-reinforced cement composite.

Figure 16:
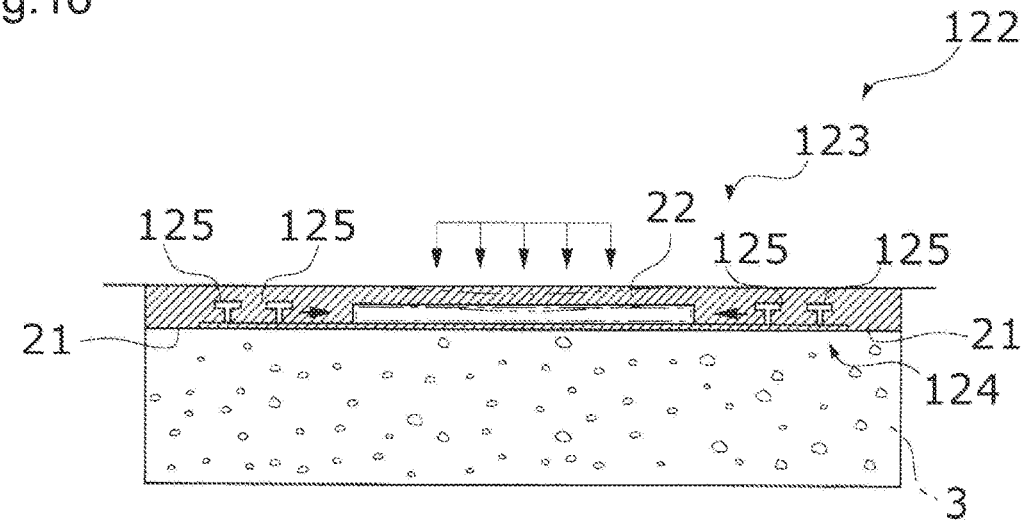
FIG. 16 is a diagram illustrating operation of the facility protection cover according to the third embodiment.

FIG. 16 is a diagram showing operation of the facility protection cover 122 and the facility protection structure 121 using the same according to the present embodiment.

In the case of the present embodiment, when the weight of the EV 14 is loaded on the bridging portion 22, tensile strain is generated in the bridging portion 22 at the lower part in the cross section thereof, which acts to spread the legs 21 in a direction away from each other. However, the tension resisting action of the tension resisting plate 124 prevents the above-mentioned tensile strain, which should be originally generated, from being generated. Therefore, a compressive force against the above-described spreading force acts as a reaction force from the studs 125 of the tension resisting plate 124 to the surrounding concrete region (see arrows in FIG. 16).

Accordingly, in the bridging portion 22, generation of tensile strain is suppressed, and conversely, compressive strain occurs. This, following the same principle as in prestressed structures, not only restricts bending deformation, but also reduces deflection. Therefore, the loaded weight of the EV 14 does not reach the facility device accommodated in the facility device placement space immediately below the bridging portion 22 to damage the facility device.

Figure 17A:
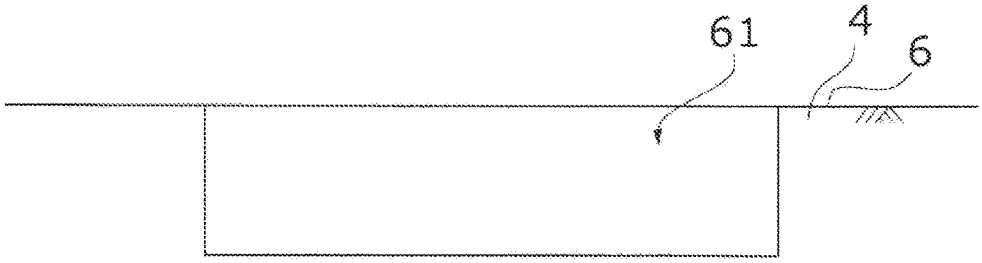
FIGS. 17A to 17D are diagrams showing a construction procedure of a facility protection structure using the facility protection cover according to the third embodiment.

In order to construct the facility protection structure 121 using the facility protection cover 122 according to the present embodiment, the concrete pavement body 4 is first dug down from the upper surface 6 to form an installation space 61 as shown in FIG. 17A.

When the facility protection structure 1 is constructed simultaneously with the construction of the concrete pavement body 4, the installation space 61 may be formed by using a formwork or the like.

Figure 17B:
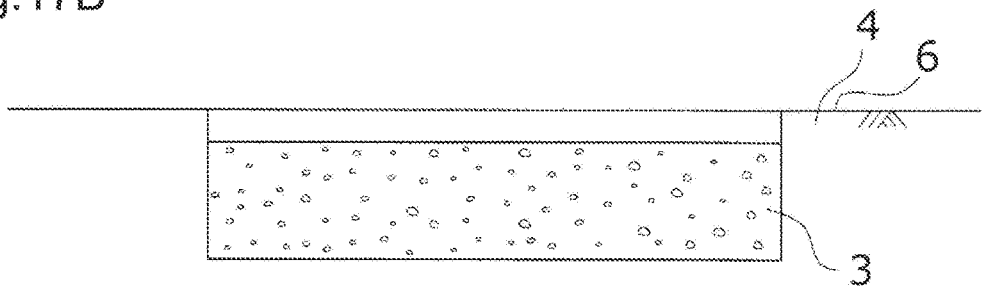

Next, the concrete foundation 3 is constructed in the installation space 61 (FIG. 17B). The concrete foundation 3 may be constituted by using normal-weight concrete or the like.

On the other hand, the accommodating case 101 is attached in advance to the cover side (the side from which the studs 125 protrude) of the tension resisting plate 124. Also, the contactless power feeding coils 62 are arranged in the facility device placement space 8 by arranging the contactless power feeding coils 62 in an accommodating case 101.

Figure 17C:
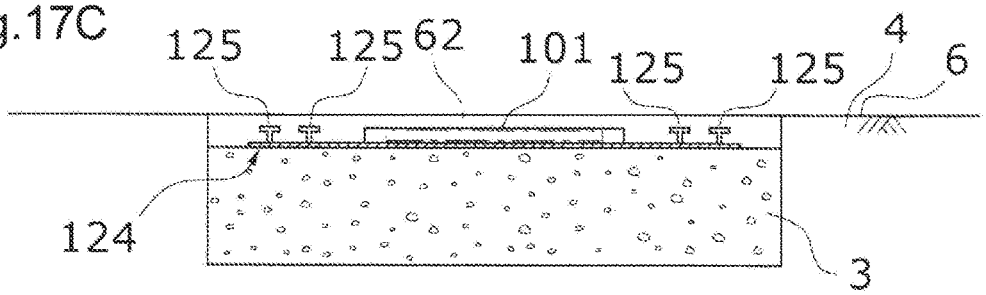

Next, after the concrete foundation 3 is cured for an appropriate period, the tension resisting plate 124, to which the accommodating case 101 is attached, is installed on the placement surface 9 of the concrete foundation 3 with the contactless power feeding coils 62 accommodated in the accommodating case 101 (FIG. 17C).

Figure 17D:
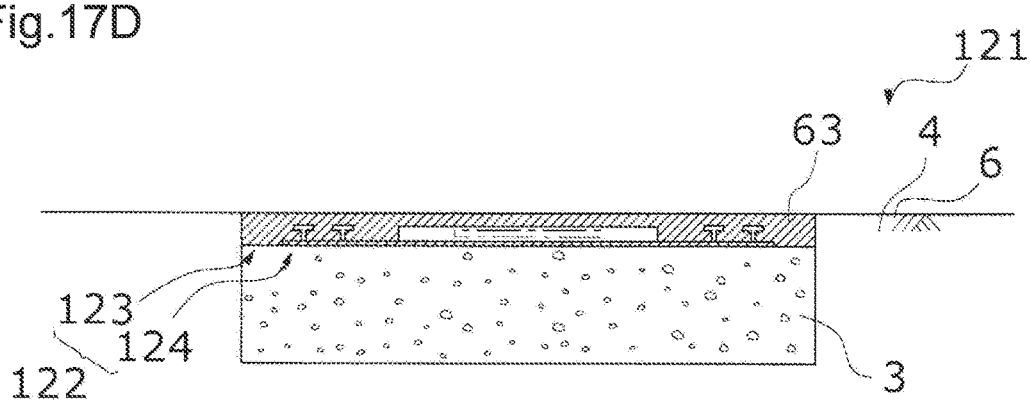

Next, the fiber-reinforced cement composite 63 is placed on the tension resisting plate 124 and the concrete foundation 3 to provide the cover body 123 thereon, thereby forming the facility protection cover 122. The construction of the facility protection structure 121 is thus completed (FIG. 17D).

When the fiber-reinforced cement composite 63 is placed, care should be taken to ensure that the studs 125 are embedded in the fiber-reinforced cement composite 63 in a desirable manner.

As described above, the facility protection cover 122 and the facility protection structure 121 using the same according to the present embodiment are configured such that the facility protection cover 122 is embedded in the concrete pavement body 4 together with the concrete foundation 3 so that the upper surface 5 of the facility protection cover 122 forms the road surface 7 together with the upper surface 6 of the concrete pavement body 4, which extends around the facility protection cover 122. Also, the cover body 123 is made of the fiber-reinforced cement composite 63. Therefore, favorable tensile strength characteristics of the fiber-reinforced cement composite 63 are exhibited, improving the toughness of the bridging portion 22 and reducing bending deformation.

Since there is no possibility that excessive bending cracks or bending deflections occur in the bridging portion 22, the road surface functions for traveling vehicles and the protective function for the contactless power feeding coils 62 are maintained without increasing the thickness of the bridging portion 22. Since it is not necessary to increase the thickness of the bridging portion 22, the power feeding efficiency to the power receiving coil 16 is ensured.

In particular, in the present embodiment, the separating relative movement of the two legs 21 along the placement surface 9 of the concrete foundation 3 is restricted by the tension resisting action of the tension resisting plate 124. Therefore, even when the weight of the EV 14 is loaded on the bridging portion 22, the above-described tensile strain, which should be originally generated in the lower part in the cross section, is not generated in the bridging portion 22. Therefore, a compressive force acts from the opposite sides via the two legs 21.

Accordingly, in the bridging portion 22, generation of tensile strain due to bending deformation is suppressed, and conversely, compressive strain occurs, due to the same principle as in prestressed structures. This configuration improves the road surface function for traveling vehicles and the protective function for the contactless power feeding coils 62 as described above, while reducing the thickness of the bridging portion 22. The configuration further improves the power feeding efficiency to the power receiving coil 16.

In addition, with the facility protection cover 122 and the facility protection structure 121 using the same according to the present embodiment, the tension resisting plate 124 is made of an aluminum plate as a conductive material. Therefore, the tension resisting plate 124 functions as an electromagnetic shield to block the electromagnetic influence from the outside to the facility device and the electromagnetic influence to the outside. In addition, since the aluminum plate is also a nonmagnetic material, the eddy-current loss in the tension resisting plate 124 due to the magnetic flux generated from the contactless power feeding coils 62 is suppressed.

Figure 18A:
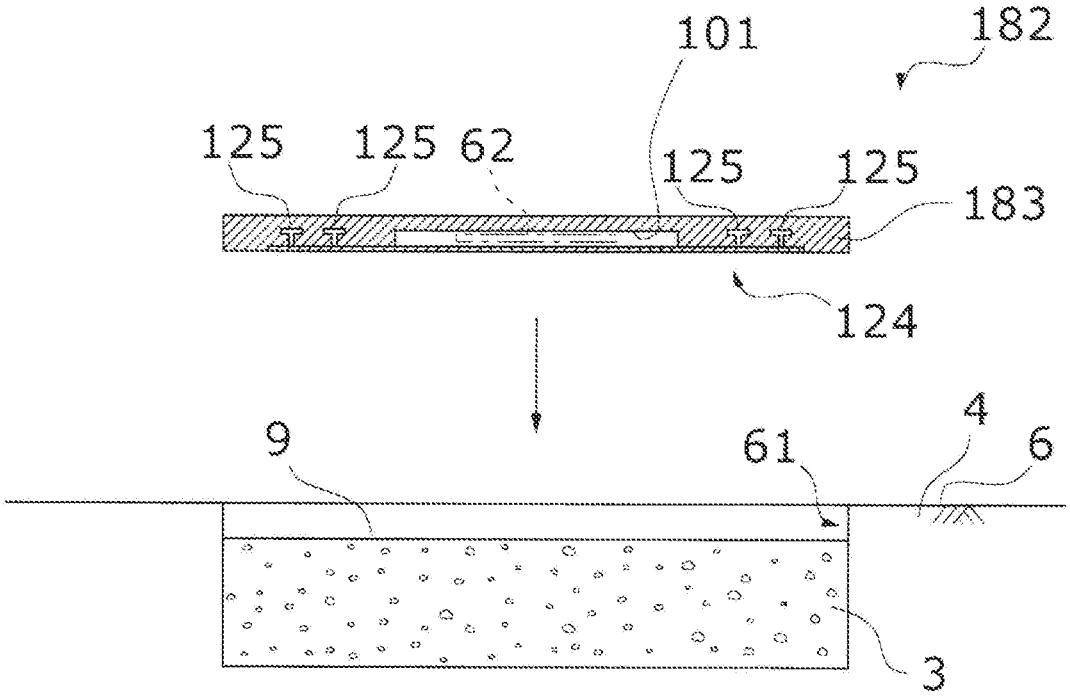
FIGS. 18A and 18B are diagrams showing a construction procedure of a facility protection structure using a facility protection cover according to a modification.
Figure 18B:
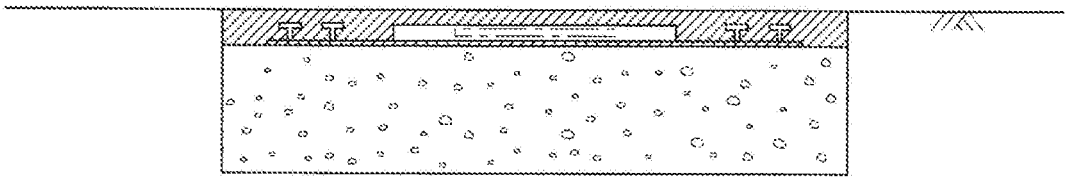

In the present embodiment, it is assumed that the facility protection cover is manufactured on site, but instead of this, as shown in FIGS. 18A and 18B, it is possible to use a facility protection cover 182 manufactured as a precast concrete member.

In such a modification, first, an installation space 61 is formed by digging down the concrete pavement body 4 from the upper surface 6, as shown in FIG. 18A. Then the concrete foundation 3 is constructed in the installation space 61. Thereafter, the facility protection cover 182 is superposed on the placement surface 9 of the concrete foundation 3 (FIG. 18B).

The facility protection cover 182 includes a cover body 183 and a tension resisting plate 124. Specifically, the accommodating case 101 is attached in advance to the cover side (the side from which the studs 125 protrude) of the tension resisting plate 124. Also, the contactless power feeding coils 62 are arranged in the facility device placement space 8 by arranging the contactless power feeding coils 62 in an accommodating case 101. Next, the fiber-reinforced cement composite 63 is placed on the tension resisting plate 124 so that the studs 125 protruding from the cover side of the tension resisting plate 124 are embedded therein, thereby forming the cover body 183.

In the present embodiment, the facility devices are the contactless power feeding coils 62. However, as long as the facility device is to be protected from the load of a vehicle traveling on the road surface, the facility device can be any device. For example, the facility device may be a communication device.

In the present embodiment, the contactless power feeding coils 62, which are facility devices, are disposed in the facility device placement space 8 in a state of being accommodated in the accommodating case 101. However, if the facility device may be directly embedded in concrete, the accommodating case 101 may be omitted.

In the present embodiment, the tension resisting plate 124 is made of an aluminum plate, which is a conductive material. However, the tension resisting plate 124 may be made of, for example, a plastic plate if there is no need for electromagnetic shielding.

Further, in the present embodiment, the tension resisting means is the tension resisting plate 124, which is a flat plate. However, any group of components may be used as the tension resisting means if it can restrict separating relative movement of two legs along a placement surface of a concrete foundation. For example, instead of the tension resisting plate 124, a plastic sheet fixed to the cover side (that is, the side facing the cover body) of each of the two legs 21 may be used.

In addition, the tension resisting means described in the present embodiment or the modification thereof, that is, the tension resisting plate 124, the plastic plate, or the plastic sheet can be added to the configuration of the first embodiment or the configuration of the second embodiment.

Figure 19A:
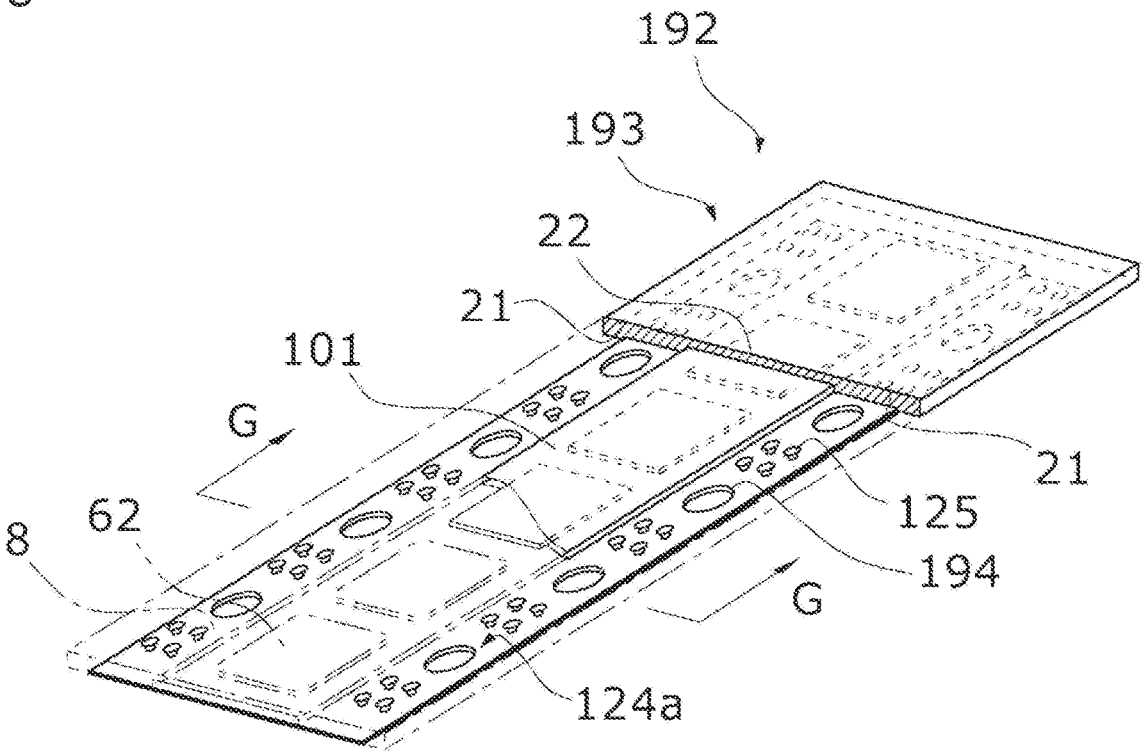
FIG. 19A is an overall perspective view of a facility protection cover according to another modification, with a portion thereof omitted.
Figure 19B:
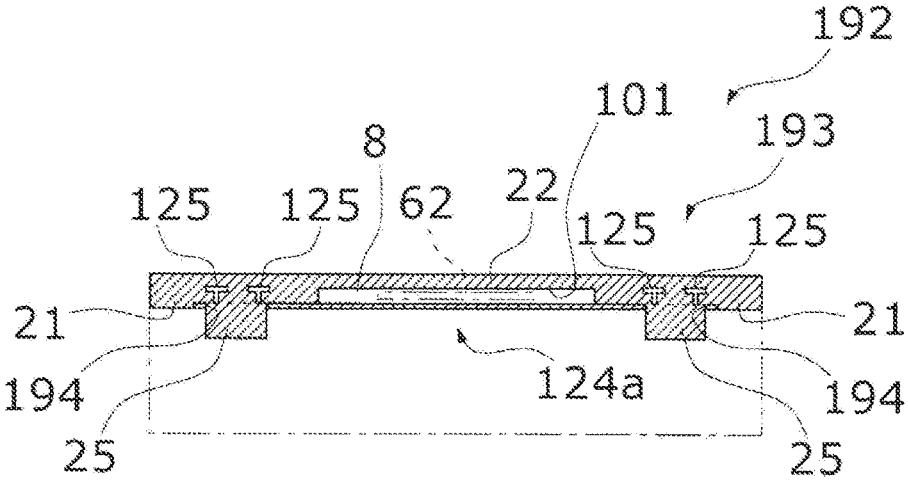
FIG. 19B is a transverse sectional view taken along line G-G in FIG. 19A.

A facility protection cover 192 according to a modification shown in FIGS. 19A and 19B is an example in which the configuration of the first embodiment is added to the configuration of the present embodiment. Specifically, the facility protection cover 192 includes a cover body 193, which includes two legs 21 and a bridging portion 22, and a tension resisting plate 124*a*. The two legs 21 are spaced apart from each other. The bridging portion 22 bridges the two legs 21. The tension resisting plate 124*a* serves as tension resisting means displaced on surfaces of the two legs 21 that face a concrete foundation. An accommodating case 101 is disposed in the space surrounded by the legs 21, the bridging portion 22, and the tension resisting plate 124*a*, as in the present embodiment. The accommodating case 101 includes a facility device placement space 8, which is an internal space. Contactless power feeding coils 62 can be disposed in the facility device placement space 8.

As in the present embodiment, the cover body 193 is configured to transmit the weight of the EV 14 loaded thereon to the concrete foundation 3 through the two legs 21 and optionally the tension resisting plate 124*a*. The tension resisting plate 124*a* is coupled to the two legs 21 by embedding, in the two legs 21, studs 125 as fixing portions protruding from the cover side (i.e., the side facing the cover body) of the tension resisting plate 124*a*. This configuration restricts a separating relative movement of the two legs 21 in a direction along the placement surface 9 of the concrete foundation 3, typically in the horizontal direction, when the weight of the EV 14 is loaded onto the bridging portion 22. The cover body 123 is made of a fiber-reinforced cement composite 63.

In the present modification, circular recesses 24 are formed in the placement surface 9 of the concrete foundation. 3. Circular protrusions 25 to be engaged with the circular recesses 24 are provided on the sides of the two legs 21 facing the concrete foundation 3, respectively. Circular through openings 194, through which the circular protrusions 25 are inserted, are formed in the tension resisting plate 124*a*.

Figure 20A:
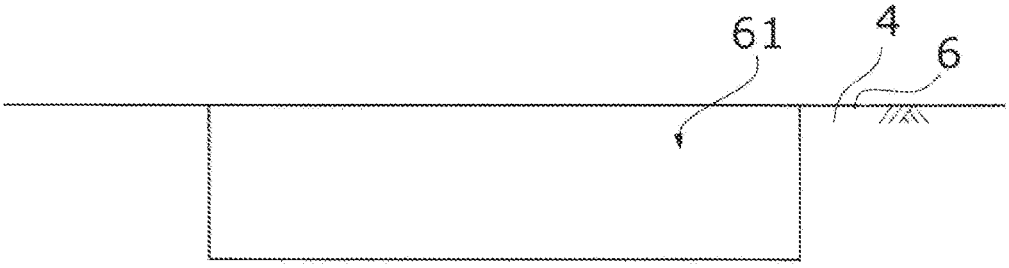
FIGS. 20A to 20D are diagrams showing a construction procedure of a facility protection structure using the facility protection cover shown in FIG. 19A.

In order to construct the facility protection structure using the facility protection cover 192 according to the present modification, the concrete pavement body 4 is first dug down from the upper surface 6 to form an installation space 61 as shown in FIG. 20A.

When the facility protection structure is constructed simultaneously with the construction of the concrete pavement body 4, the installation space 61 may be formed by using a formwork or the like.

Figure 20B:
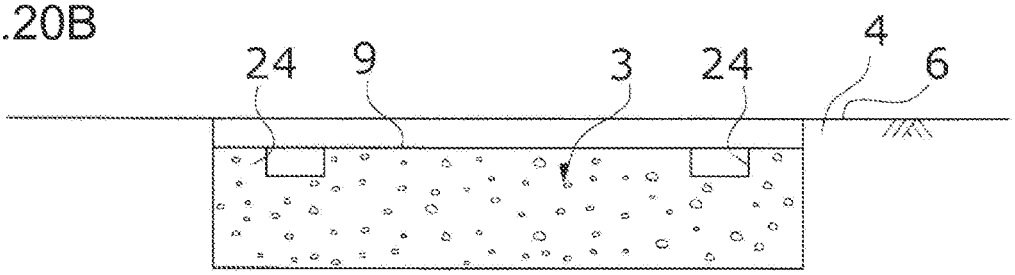

Next, the concrete foundation 3 is constructed in the installation space 61 (FIG. 20B).

The concrete foundation 3 may be constituted by using normal-weight concrete or the like. At the time of construction, the circular recesses 24 are formed on the placement surface 9 by means such as a block-out.

On the other hand, the accommodating case 101 is attached in advance to the cover side (the side from which the studs 125 protrude) of the tension resisting plate 124*a*. Also, the contactless power feeding coils 62 are arranged in the facility device placement space 8 by arranging the contactless power feeding coils 62 in an accommodating case 101.

Figure 20C:
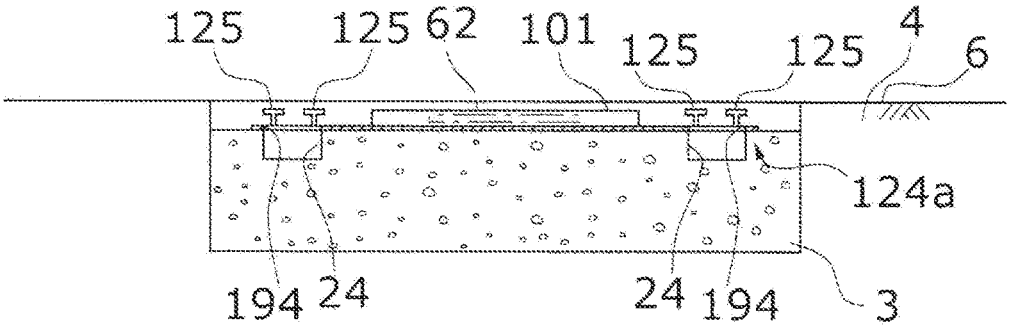

Next, after the concrete foundation 3 is cured for an appropriate period of time, the tension resisting plate 124*a* to which the accommodating case 101 is attached is placed on the placement surface 9 of the concrete foundation 3 so that the through openings 194 of the tension resisting plate 124*a* agree with the circular recesses 24 (FIG. 20C).

Figure 20D:
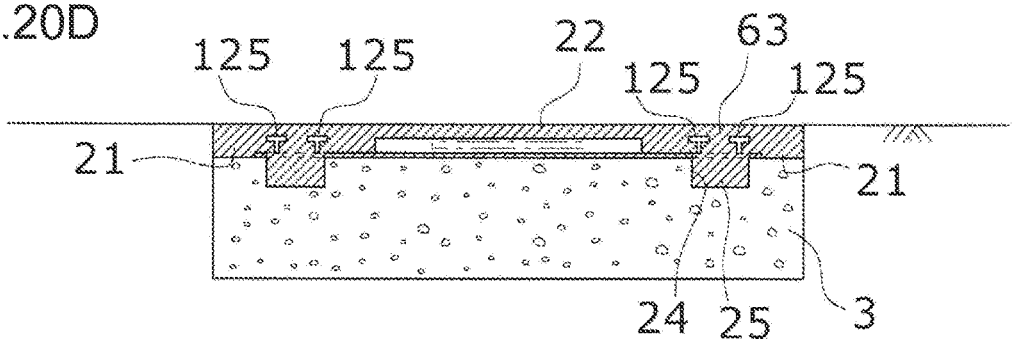

Next, the fiber-reinforced cement composite 63 is placed on the tension resisting plate 124 and the concrete foundation 3 to provide the cover body 193 thereon, thereby forming the facility protection cover 192. The construction of the facility protection structure is thus completed (FIG. 20D).

When the fiber-reinforced cement composite 63 is placed, care should be taken to ensure that the studs 125 are embedded in the fiber-reinforced cement composite 63 in a desirable manner, and that the fiber-reinforced cement composite 63 properly fills the circular recesses 24 provided in the placement surface 9 of the concrete foundation 3.

The facility protection cover 192 and the facility protection structure using the same according to the present modification achieve the advantages of the first embodiment in addition to the advantages of the present embodiment (third embodiment). The description thereof is omitted here.

The invention claimed is:

1. A facility protection cover that is configured to be disposed on a concrete foundation and to cover a facility device disposed between the facility protection cover and the concrete foundation, the facility protection cover comprising:

a cover body including a fiber-reinforced cement composite, the cover body including:

two legs that are spaced apart from each other so as to be located on opposite sides of a facility device placement space, the facility device placement space being configured to accommodate the facility device; and a bridging portion that bridges the two legs so as to extend over the facility device placement space, wherein the cover body is configured to transmit a weight of a vehicle loaded on the cover body to the concrete foundation via the two legs, and restrict a separating relative movement of the two legs along a placement surface of the concrete foundation when the weight of the vehicle is loaded on the bridging portion, wherein each of the two legs includes a cover-side non-flat portion on a side facing the concrete foundation, and the cover-side non-flat portion is configured to engage with a placement surface-side non-flat portion provided on the placement surface.

2. The facility protection cover according to claim 1, wherein the two legs respectively include edge-side surfaces on far sides, each leg being configured such that the edge-side surface comes into contact with a shoulder portion protruding from the placement surface.

3. A facility protection cover that is configured to be disposed on a concrete foundation and to cover a facility device disposed between the facility protection cover and the concrete foundation, the facility protection cover comprising:

a cover body including a fiber-reinforced cement composite, the cover body including:

two legs that are spaced apart from each other so as to be located on opposite sides of a facility device placement space, the facility device placement space being configured to accommodate the facility device; and a bridging portion that bridges the two legs so as to extend over the facility device placement space, wherein the cover body is configured to transmit a weight of a vehicle loaded on the cover body to the concrete foundation via the two legs, and restrict a separating relative movement of the two legs along a placement surface of the concrete foundation when the weight of the vehicle is loaded on the bridging portion, wherein tension resisting means is disposed on a side of each of the two legs facing the concrete foundation, and the tension resisting means is coupled to the two legs so as to restrict separating relative movement of the two legs along the placement surface.

4. The facility protection cover according to claim 3, wherein the tension resisting means is a flat plate, fixing portions are provided so as to protrude on a side of the flat plate facing the cover body, and the fixing portions are respectively embedded in the two legs.

5. The facility protection cover according to claim 4, wherein the flat plate include a conductive material.

6. The facility protection cover according to claim 3, wherein the tension resisting means is a plastic sheet, and the plastic sheet is fixed to sides of the two legs facing the cover body.

7. The facility protection cover according to claim 1, wherein the cover body is a precast concrete member.

8. The facility protection cover according to claim 1, wherein the fiber-reinforced cement composite is a high performance fiber-reinforced cement composite (HPFRCC).

9. A facility protection structure, comprising:

a facility protection cover; and a concrete foundation, wherein the facility protection cover is configured to be disposed on the concrete foundation and to cover a facility device disposed between the facility protection cover and the concrete foundation, and comprises:

a cover body including a fiber-reinforced cement composite, the cover body including:

two legs that are spaced apart from each other so as to be located on opposite sides of a facility device placement space, the facility device placement space being configured to accommodate the facility device; and a bridging portion that bridges the two legs so as to extend over the facility device placement space, wherein the cover body is configured to transmit a weight of a vehicle loaded on the cover body to the concrete foundation via the two legs, and restrict a separating relative movement of the two legs along a placement surface of the concrete foundation when the weight of the vehicle is loaded on the bridging portion, and wherein the facility protection cover is configured to be embedded together with the concrete foundation in a pavement body extending around the facility protection cover so that an upper surface of the facility protection cover forms a road surface together with an upper surface of the pavement body.

10. The facility protection structure according to claim 9, wherein each of the two legs includes a cover-side non-flat portion on a side facing the concrete foundation, and the cover-side non-flat portion is configured to engage with a placement surface-side non-flat portion provided on the placement surface.

11. The facility protection structure according to claim 9, wherein the two legs respectively include edge-side surfaces on far sides, each leg being configured such that the edge-side surface comes into contact with a shoulder portion protruding from the placement surface.

12. The facility protection structure according to claim 9, wherein tension resisting means is disposed on a side of each of the two legs facing the concrete foundation, and the tension resisting means is coupled to the two legs so as to restrict separating relative movement of the two legs along the placement surface.

13. The facility protection structure according to claim 12, wherein the tension resisting means is a flat plate, fixing portions are provided so as to protrude on a side of the flat plate facing the cover body, and the fixing portions are respectively embedded in the two legs.

14. The facility protection structure according to claim 13, wherein the flat plate include a conductive material.

15. The facility protection structure according to claim 12, wherein the tension resisting means is a plastic sheet, and the plastic sheet is fixed to sides of the two legs facing the cover body.

16. The facility protection structure according to claim 9, wherein the cover body is a precast concrete member.

17. The facility protection structure according to claim 9, wherein the fiber-reinforced cement composite is a high performance fiber-reinforced cement composite (HPFRCC).

* * * * *